US010638551B2

(12) United States Patent
Liu et al.

(10) Patent No.: US 10,638,551 B2
(45) Date of Patent: Apr. 28, 2020

(54) ELECTROMAGNETIC HEATING CONTROL CIRCUIT AND ELECTROMAGNETIC HEATING DEVICE

(71) Applicants: FOSHAN SHUNDE MIDEA ELECTRICAL HEATING APPLIANCES MANUFACTURING CO., LIMITED, Foshan (CN); MIDEA GROUP CO., LTD., Foshan (CN)

(72) Inventors: Zhicai Liu, Foshan (CN); Zhifeng Wang, Foshan (CN); Wenfeng Weng, Foshan (CN); Dali Ou, Foshan (CN); Zhihai Ma, Foshan (CN); Shirun Wu, Foshan (CN); Yifan Chen, Foshan (CN); Xinyuan Wang, Foshan (CN)

(73) Assignees: FOSHAN SHUNDE MIDEA ELECTRICAL HEATING APPLIANCES MANUFACTURING CO., LTD, Foshan (CN); MIDEA GROUP CO., LTD., Foshan (CN)

( * ) Notice: Subject to any disclaimer, the term of this patent is extended or adjusted under 35 U.S.C. 154(b) by 472 days.

(21) Appl. No.: 15/665,044

(22) Filed: Jul. 31, 2017

(65) Prior Publication Data

US 2018/0020507 A1 Jan. 18, 2018

Related U.S. Application Data

(63) Continuation of application No. PCT/CN2015/082969, filed on Jun. 30, 2015.

(30) Foreign Application Priority Data

Feb. 2, 2015 (CN) ..... 2015 1 0054021
Feb. 2, 2015 (CN) ..... 2015 1 0054338
(Continued)

(51) Int. Cl.
*H05B 1/02* (2006.01)
*H05B 6/06* (2006.01)

(52) U.S. Cl.
CPC ..... *H05B 6/06* (2013.01)

(58) Field of Classification Search
CPC . H05B 1/26; H05B 6/06; H05B 6/666; H05B 6/687
(Continued)

(56) References Cited

U.S. PATENT DOCUMENTS 3,819,960 A * 6/1974 Kohn ..... G01K 7/021 327/518
4,736,090 A * 4/1988 De Broeck ..... G03G 15/2003 219/216
(Continued)

FOREIGN PATENT DOCUMENTS

CN 101808433 A 8/2010
CN 202424663 U 9/2012
(Continued)

OTHER PUBLICATIONS

International Search Report and Written Opinion, PCTCN2015082969, dated Oct. 29, 2015, 22 pgs.
(Continued)

*Primary Examiner* — Mark H Paschall
(74) *Attorney, Agent, or Firm* — Morgan, Lewis & Bockius LLP

(57) ABSTRACT

Disclosed is an electromagnetic heating control circuit, comprising a control chip, a rectifier filter circuit, a resonant capacitor, a switching transistor, a drive circuit, and a synchronous voltage detection circuit. The switching transistor comprises a first end, a second end, and a control end. The first end is connected to a positive output end of the rectifier filter circuit by using the resonant capacitor. The
(Continued)

second end is connected to a negative output end of the rectifier filter circuit by using a current limiting resistor. The control chip comprises a positive phase voltage input end, a negative phase voltage input end, a voltage detection end, and a signal input end. The positive phase voltage input end and the negative phase voltage input end detect voltages at two ends of the resonant capacitor by using the synchronous voltage detection circuit. The signal output end is connected to the control end by using the drive circuit. The voltage detection end is connected to the positive output end of the rectifier filter circuit by using the synchronous voltage detection circuit. The control chip controls a working state of the switching transistor according to a voltage detected by the voltage detection end. Further disclosed is an electromagnetic heating device.

23 Claims, 7 Drawing Sheets

(30) Foreign Application Priority Data

| | | |
|---|---|---|
| Feb. 2, 2015 | (CN) | 2015 1 0054340 |
| Feb. 2, 2015 | (CN) | 2015 2 0073503 U |
| Feb. 2, 2015 | (CN) | 2015 2 0073792 U |
| Feb. 2, 2015 | (CN) | 2015 2 0073807 U |
| Feb. 3, 2015 | (CN) | 2015 1 0057187 |
| Feb. 3, 2015 | (CN) | 2015 1 0057243 |
| Feb. 3, 2015 | (CN) | 2015 2 0077828 U |
| Feb. 3, 2015 | (CN) | 2015 2 0077907 U |
| Feb. 3, 2015 | (CN) | 2015 2 0077908 U |

(58) Field of Classification Search
USPC ..... 219/482, 481, 494, 497, 501, 507
See application file for complete search history.

(56) References Cited

U.S. PATENT DOCUMENTS

| | | | | |
|---|---|---|---|---|
| 5,397,874 | A * | 3/1995 | Griffith | B23K 3/033 219/492 |
| 6,870,329 | B2 * | 3/2005 | Krieger | H05B 39/047 315/291 |
| 2005/0067410 | A1 * | 3/2005 | Ring | H05B 6/06 219/661 |
| 2005/0205549 | A1 * | 9/2005 | Crawford | H05B 1/0288 219/494 |

FOREIGN PATENT DOCUMENTS

| | | | |
|---|---|---|---|
| CN | 202679686 | U | 1/2013 |
| CN | 203136220 | U | 8/2013 |
| CN | 103313451 | A | 9/2013 |
| CN | 204362014 | U | 5/2015 |
| CN | 204362337 | U | 5/2015 |
| CN | 204391741 | U | 6/2015 |
| JP | 57-155692 | U | 9/1982 |
| JP | 3831298 | B2 | 10/2006 |
| JP | 2009-26516 | | 2/2009 |

OTHER PUBLICATIONS

Notification of Reason for Refusal, KR1020177024696, dated Nov. 27, 2018, 15 pgs.
Midea, Office Action, CN201510057243.3, dated Jan. 14, 2019, 7 pgs.

* cited by examiner

ELECTROMAGNETIC HEATING CONTROL CIRCUIT AND ELECTROMAGNETIC HEATING DEVICE

RELATED APPLICATIONS

This application is a continuation application of PCT Patent Application No. PCT/CN2015/082969, entitled "ELECTROMAGNETIC HEATING CONTROL CIRCUIT AND ELECTROMAGNETIC HEATING DEVICE" filed on Jun. 30, 2015, which claims priority to Chinese Patent Application No. 201510054338.X, entitled "ELECTROMAGNETIC HEATING CONTROL CIRCUIT AND ELECTROMAGNETIC HEATING DEVICE" filed on Feb. 2, 2015, Chinese Patent Application No. 201520073807.8, entitled "ELECTROMAGNETIC HEATING CONTROL CIRCUIT AND ELECTROMAGNETIC HEATING DEVICE" filed on Feb. 2, 2015, Chinese Patent Application No. 201510054021.6, entitled "ELECTROMAGNETIC HEATING CONTROL CIRCUIT AND ELECTROMAGNETIC HEATING DEVICE" filed on Feb. 2, 2015, Chinese Patent Application No. 201520073503.1, entitled "ELECTROMAGNETIC HEATING CONTROL CIRCUIT AND ELECTROMAGNETIC HEATING DEVICE" filed on Feb. 2, 2015, Chinese Patent Application No. 201510054340.7, entitled "ELECTROMAGNETIC HEATING CONTROL CIRCUIT AND ELECTROMAGNETIC HEATING DEVICE" filed on Feb. 2, 2015, Chinese Patent Application No. 201520073792.5, entitled "ELECTROMAGNETIC HEATING CONTROL CIRCUIT AND ELECTROMAGNETIC HEATING DEVICE" filed on Feb. 2, 2015, Chinese Patent Application No. 201520077907.8, entitled "ELECTROMAGNETIC HEATING CONTROL CIRCUIT AND ELECTROMAGNETIC HEATING DEVICE" filed on Feb. 3, 2015, Chinese Patent Application No. 201510057243.3, entitled "ELECTROMAGNETIC HEATING CONTROL CIRCUIT AND ELECTROMAGNETIC HEATING DEVICE" filed on Feb. 3, 2015, and Chinese Patent Application No. 201520077828.7, entitled "WATER PURIFICATION SYSTEM", filed on Feb. 3, 2015, all of which are incorporated by reference in their entirety.

TECHNICAL FIELD

The present disclosure relates to an electromagnetic heating technology field, and more particularly to an electromagnetic heating control circuit and an electromagnetic heating device.

BACKGROUND

It is well known that, an input alternating current power source should be detected in electromagnetic heating control circuits in the related art, and power of a system of an electromagnetic heating device is controlled by using a control chip or a controller to detect a voltage of an input terminal of a rectifying and filtering circuit. In the related art, the input terminal of the rectifying and filtering circuit is generally provided with a voltage sampling circuit for voltage detection. However, structures of the voltage sampling circuit are complex, thus causing high cost of circuit design and high power consumption.

SUMMARY

A main objective of the present disclosure is to provide an electromagnetic heating control circuit and an electromagnetic heating device, seeking to reduce cost and power consumption of circuit design.

In order to achieve the above objective, embodiments of the present disclosure provide an electromagnetic heating control circuit, including: a control chip 10, a rectifying and filtering circuit 20, a resonance capacitor C, a switch transistor Q, a drive circuit 30, and a synchronous voltage detection circuit, in which, the switch transistor Q includes a first terminal, a second terminal, and a control terminal configured to control a connection state between the first terminal and the second terminal, the first terminal is connected to a positive output terminal of the rectifying and filtering circuit 20 via the resonance capacitor C, the second terminal is connected to a negative output terminal of the rectifying and filtering circuit 20 via a current-limiting resistor R11; the control chip 10 includes a non-inverting voltage input terminal, an inverting voltage input terminal, a voltage detection terminal, and a signal output terminal, the non-inverting voltage input terminal and the inverting voltage input terminal detect voltages at two terminals of the resonance capacitor C via the synchronous voltage detection circuit, the signal output terminal is connected to the control terminal via the drive circuit 30, the voltage detection terminal is connected to the positive output terminal of the rectifying and filtering circuit 20 via the synchronous voltage detection circuit, the control chip 10 is configured to control a work state of the switch transistor Q according to a voltage detected by the voltage detection terminal, and to control, according to voltages of the non-inverting voltage input terminal and the inverting voltage input terminal, the switch transistor Q to turn on when a voltage at a connection node between the resonance capacitor C and the switch transistor Q is zero.

In an embodiment of the present disclosure, the synchronous voltage detection circuit includes: a first voltage sampling circuit and a second voltage sampling circuit. One terminal of the first voltage sampling circuit is connected to the positive output terminal of the rectifying and filtering circuit 20, and the other terminal of the first voltage sampling circuit is connected to the non-inverting voltage input terminal. An input terminal of the second voltage sampling circuit is connected to the first terminal of the switch transistor Q, a first output terminal of the second voltage sampling circuit is connected to the inverting voltage input terminal, and a second output terminal of the second voltage sampling circuit is connected to the voltage detection terminal.

In an embodiment of the present disclosure, the first voltage sampling circuit includes a tenth resistor R10 and a twelfth resistor R12, one terminal of the tenth resistor R10 is connected to the positive output terminal of the rectifying and filtering circuit 20, the other terminal of the tenth resistor R10 is grounded via the twelfth resistor R12; a common terminal of the tenth resistor R10 and the twelfth resistor R12 is connected to the non-inverting voltage input terminal; the second voltage sampling circuit includes a thirteenth resistor R13 and a fourteenth resistor R14, one terminal of the thirteenth resistor R13 is connected to the first terminal of the switch transistor Q, the other terminal of the thirteenth resistor R13 is grounded via the fourteenth resistor R14, and a common terminal of the thirteenth resistor R13 and the fourteenth resistor R14 is connected to the inverting voltage input terminal.

In an embodiment of the present disclosure, the drive circuit 30 includes a drive chip 31, a fifteenth resistor R15, a sixteenth resistor R16, and a seventeenth resistor R17, in which, a drive input terminal of the drive chip 31 is connected to the signal output terminal via the fifteenth resistor R15, the drive input terminal is connected to a preset power source, a drive output terminal of the drive chip 31 is connected to the second terminal of the switch transistor Q via a serial connection of the sixteenth resistor R16 and the seventeenth resistor R17, a common terminal of the sixteenth resistor R16 and the seventeenth resistor R17 is connected to the control terminal of the switch transistor Q.

In an embodiment of the present disclosure, the drive circuit 30 further includes a Zener diode D, a cathode of the Zener diode D is connected to the control terminal, and an anode of the Zener diode D is connected to the second terminal of the switch transistor Q.

In an embodiment of the present disclosure, the rectifying and filtering circuit 20 includes a bridge rectifier 21, an inductor L0 and a capacitor C12, in which, a positive output terminal of the bridge rectifier 21 is connected to the resonance capacitor C via the inductor L0, and a negative output terminal of the bridge rectifier 21 is connected to the second terminal of the switch transistor Q via the current-limiting resistor R11; one terminal of the capacitor C12 is connected to a common terminal of the inductor L0 and resonance capacitor C, and the other terminal of the capacitor C12 is connected to the negative output terminal of the bridge rectifier 21.

In an embodiment of the present disclosure, the switch transistor Q is an insulated gate bipolar transistor, a collector of the insulated gate bipolar transistor is configured as the first terminal, an emitter of the insulated gate bipolar transistor is configured as the second terminal, and a gate of the insulated gate bipolar transistor is configured as the control terminal.

In embodiments of the present disclosure, by directly connecting the voltage detection terminal of the control chip to the output terminal of the rectifying and filtering circuit, that is, connecting the voltage detection terminal of the control chip to the output terminal of the rectifying and filtering circuit via the first sampling circuit of the synchronous circuit, power control and under-voltage and over-voltage protection of mains supply can be realized according to the voltage of the output terminal of the rectifying and filtering circuit. Relative to providing a voltage sampling circuit at the input terminal of the rectifying and filtering circuit to detect the voltage of the input terminal of the rectifying and filtering circuit in the related art, the present disclosure uses the synchronous voltage detection circuit to detect the voltage of the output terminal of the rectifying and filtering circuit and performs the power control and the under-voltage and over-voltage protection of mains supply, thus reducing cost and power consumption of circuit design.

Embodiments of the present disclosure provide an electromagnetic heating control circuit, including: a drive circuit, a protection circuit and a switch transistor, in which, the switch transistor includes a first terminal, a second terminal, and a control terminal configured to control a connection state between the first terminal and the second terminal, the control terminal is connected to a signal output terminal of the drive circuit, and the second terminal is connected to a ground terminal;

the drive circuit is connected to a preset control chip, and configured to magnify a pulse width modulation signal received from the control chip and to output a magnified pulse width modulation signal to the switch transistor via the signal output terminal of the drive circuit, so as to drive the switch transistor;

the drive circuit is configured to detect an output voltage value of the signal output terminal, and to adjust a state of the magnified pulse width modulation signal output by the signal output terminal according to whether the output voltage value of the signal output terminal is within a preset interval range;

the protection circuit is configured to control a work state of the switch transistor according to a voltage value of the first terminal when the switch transistor is turned off, or the protection circuit is configured to control the work state of the switch transistor according to a detected current value of the second terminal when the switch transistor is turned on.

Preferably, when the protection circuit adjusts a state of the magnified pulse width modulation signal output by the signal output terminal according to the output voltage value of the signal output terminal, when the output voltage value of the signal output terminal is not within the preset interval range, the drive circuit controls the signal output terminal stop outputting the magnified pulse width modulation signal;

or, when the output voltage value of the signal output terminal is not within the preset interval range, the drive circuit outputs a control signal to the control chip, such that the control chip stops outputting the pulse width modulation signal.

Preferably, the drive circuit is further configured to perform a comparison on the pulse width modulation signal and a preset reference square signal, and to adjust the state of the magnified pulse width modulation signal output by the signal output terminal according to a result of the comparison.

Preferably, the switch transistor is an insulated gate bipolar transistor, a collector of the insulated gate bipolar transistor is configured as the first terminal, an emitter of the insulated gate bipolar transistor is configured as the second terminal, and a gate of the insulated gate bipolar transistor is configured as the control terminal.

Preferably, the drive circuit is further configured to detect a voltage between the collector and the emitter of the insulated gate bipolar transistor, to determine a work state of the insulated gate bipolar transistor according to a voltage between the collector and the emitter of the insulated gate bipolar transistor at a time when the insulated gate bipolar transistor is turned on, and to adjust a time period for the output voltage value of the signal output terminal to rise to a second preset value according to the work state.

Preferably, the work state of the insulated gate bipolar transistor includes a start state, a hard turn-on state, and a normal state;

adjusting a time period for the output voltage value of the signal output terminal to rise to a second preset value according to the work state including:

when the work state is the start state, the time period for the output voltage value of the signal output terminal to rise to the second preset value is set to be a first threshold;

when the work state is the hard turn-on state, the time period for the output voltage value of the signal output terminal to rise to the second preset value is set to be a second threshold;

when the work state is the normal state, the time period for the output voltage value of the signal output terminal to rise to the second preset value is set to be a third threshold.

Preferably when the protection circuit is configured to control the work state of the switch transistor according to the voltage value of the first terminal when the switch transistor is turned off, the protection circuit includes a voltage sampling circuit and a comparator, the voltage sampling circuit includes a first resistor and a second resistor, one terminal of the first resistor is connected to the first terminal, and the other terminal of the first resistor is connected to the ground terminal via the second resistor; a non-inverting input terminal of the comparator is connected to a common terminal of the first resistor and the second resistor, an inverting input terminal of the comparator is connected to a preset reference voltage terminal, and an output terminal of the comparator is connected to the control terminal.

Preferably, when the protection circuit is configured to control the work state of the switch transistor according to a detected current value of the second terminal when the switch transistor is turned on, the electromagnetic heating control circuit further includes a third resistor connected in series between the second terminal and the ground terminal, and a voltage detection terminal of the protection circuit is connected to the second terminal so as to detect the current value of the second terminal.

Preferably, the protection circuit is connected to the drive circuit, when the current value of the second terminal is detected to be higher than a preset value, a control signal is output to the drive circuit, such that the drive circuit controls the signal output terminal to output a preset level signal, to turn off the switch transistor.

Preferably, the protection circuit is connected to the control chip, and when the current value of the second terminal is detected to be higher than a preset value, the control signal is output to the control chip, such that the control chip adjusts a duty ratio of the pulse width modulation signal output to the drive circuit.

In addition, in order to achieve the above objective, embodiments of present disclosure further provide a household appliance. The household appliance includes an electromagnetic heating control circuit, the electromagnetic heating control circuit includes a drive circuit, a protection circuit and a switch transistor, in which, the switch transistor includes a first terminal, a second terminal, and a control terminal configured to control a connection state between the first terminal and the second terminal, the control terminal is connected to a signal output terminal of the drive circuit, and the second terminal is connected to a ground terminal;

the drive circuit is connected to a preset control chip, and configured to magnify a pulse width modulation signal received from the control chip and to output a magnified pulse width modulation signal to the switch transistor via the signal output terminal of the drive circuit, so as to drive the switch transistor;

the drive circuit is configured to detect an output voltage value of the signal output terminal, and to adjust a state of the magnified pulse width modulation signal output by the signal output terminal according to whether the output voltage value of the signal output terminal is within a preset interval range;

the protection circuit is configured to control a work state of the switch transistor according to a voltage value of the first terminal when the switch transistor is turned off, or the protection circuit is configured to control the work state of the switch transistor according to a detected current value of the second terminal when the switch transistor is turned on.

In embodiments of the present disclosure, by providing the protection circuit, the work state of the switch transistor is controlled according to the voltage value of the first terminal when the switch transistor is turned off, or the work state of the switch transistor is controlled according to current value of the second terminal when the switch transistor is turned on, thus it is effectively prevented that the voltage between the first terminal and the second terminal is so high to damage the switch transistor when the switch transistor is turned off. In addition, the drive circuit controls the state of the pulse width modulation signal output by the signal output terminal according to a voltage of signal output terminal, thus it is effectively prevented that the drive voltage of the switch transistor is so high to burn out the switch transistor and the drive voltage of the switch transistor is so low that the switch transistor cannot be turned on or in a magnifying state. Therefore, the electromagnetic heating control circuit provided in the present disclosure improves stability of circuit operation.

In order to achieve the above objective, embodiments of present disclosure provide an electromagnetic heating circuit, including: a coil, a resonance capacitor, a control chip, a drive module, a protection module, and a switch transistor, in which, the coil is connected in parallel to the resonance capacitor;

the switch transistor includes a first terminal, a second terminal, and a control terminal configured to control a connection state between the first terminal and the second terminal, the control terminal is connected to a signal output terminal of the drive module, the first terminal is connected to a terminal of the resonance capacitor, and the second terminal is connected to a ground terminal;

the control chip is configured to output a pulse width modulation signal to the drive module, the pulse width modulation signal is output to the switch transistor via the signal output terminal of the drive module, so as to drive the switch transistor;

the protection module is configured to control a work state of the switch transistor according to a voltage value of the first terminal when the switch transistor is turned off, or the protection module is configured to control the work state of the switch transistor according to a detected current value of the second terminal when the switch transistor is turned on.

Preferably, when the protection module is configured to control a work state of the switch transistor according to a voltage value of the first terminal when the switch transistor is turned off, the protection module includes a voltage sampling circuit and a comparator, the voltage sampling circuit includes a first resistor and a second resistor, one terminal of the first resistor is connected to the first terminal, and the other terminal of the first resistor is connected to the ground terminal via the second resistor; a non-inverting input terminal of the comparator is connected to a common terminal of the first resistor and the second resistor, an inverting input terminal of the comparator is connected to a preset reference voltage terminal, and an output terminal of the comparator is connected to the control terminal.

Preferably, when the protection module is configured to control a work state of the switch transistor according to a voltage value of the first terminal when the switch transistor is turned off, the protection module includes a voltage sampling circuit and a comparator, the voltage sampling circuit includes a first resistor and a second resistor, one terminal of the first resistor is connected to the first terminal, and the other terminal of the first resistor is connected to the ground terminal via the second resistor; a non-inverting input terminal of the comparator is connected to a common terminal of the first resistor and the second resistor, an inverting input terminal of the comparator is connected to a preset reference voltage terminal, and an output terminal of the comparator is connected to the drive module;

when the voltage value of the first terminal is higher than the preset reference voltage, the comparator outputs a control signal to the drive module, the drive module controls the signal output terminal to output a preset level signal according to the control signal, so as to turn on the switch transistor.

Preferably, when the protection module is configured to control a work state of the switch transistor according to a voltage value of the first terminal when the switch transistor is turned off, the protection module includes a voltage sampling circuit and a comparator, the voltage sampling circuit includes a first resistor and a second resistor, one terminal of the first resistor is connected to the first terminal, and the other terminal of the first resistor is connected to the ground terminal via the second resistor; a non-inverting input terminal of the comparator is connected to a common terminal of the first resistor and the second resistor, an inverting input terminal of the comparator is connected to a preset reference voltage terminal, and an output terminal of the comparator is connected to the control chip;

when the voltage value of the first terminal is higher than the preset reference voltage, the comparator outputs a control signal to the control chip, such that the control chip adjusts a duty ratio of the pulse width modulation signal output to the drive module.

Preferably, when the protection module is configured to control the work state of the switch transistor according to a detected current value of the second terminal when the switch transistor is turned on, the electromagnetic heating circuit further includes a third resistor connected in series between the second terminal and the ground terminal, and a voltage detection terminal of the protection module is connected to the second terminal so as to detect the current value of the second terminal.

Preferably, the protection module is connected to the drive module, and the protection module outputs a control signal to the drive module when the current value of the second terminal is detected to be higher than a preset value, such that the drive module controls the signal output terminal to output a preset level signal, so as to turn off the switch transistor.

Preferably, the protection module is connected to the control chip, and the protection module outputs a control signal to the control chip when the current value of the second terminal is detected to be higher than a preset value, such that the control chip adjusts a duty ratio of the pulse width modulation signal output to the drive module.

Preferably, the electromagnetic heating circuit further includes a temperature sensor configured to detect a temperature of the switch transistor, the temperature sensor is connected to the protection module, and the protection module is configured to output a control signal to the drive module or to the control chip according to the temperature detected by the temperature sensor, such that the drive module or the control chip adjusts a duty ratio of the pulse width modulation signal output by the signal output terminal or turns off the switch transistor according to the control signal.

Preferably, the switch transistor is an insulated gate bipolar transistor, a collector of the insulated gate bipolar transistor is configured as the first terminal, an emitter of the insulated gate bipolar transistor is configured as the second terminal, and a gate of the insulated gate bipolar transistor is configured as the control terminal.

In embodiments of the present disclosure, by providing the protection module, the work state of the switch transistor is controlled according to the voltage value of the first terminal when the switch transistor is turned off, or the work state of the switch transistor is controlled according to the current value of the second terminal when the switch transistor is turned on, thus it is effectively prevented that the voltage between the first terminal and the second terminal is so high to damage the switch transistor when the switch transistor is turned off. Therefore, the electromagnetic heating circuit provided in the present disclosure improves stability of circuit operation.

In order to achieve the above objective, embodiments of present disclosure provide an electromagnetic heating circuit, including: a control chip, a drive module, and a switch transistor, in which, the switch transistor includes a first terminal, a second terminal, and a control terminal configured to control a connection state between the first terminal and the second terminal, the control terminal is connected to a signal output terminal of the drive module;

the control chip is configured to output a pulse width modulation signal to the drive module, the pulse width modulation signal is output to the switch transistor via the signal output terminal of the drive module, so as to drive the switch transistor;

the drive module is configured to detect an output voltage value of the signal output terminal, and to adjust a state of the pulse width modulation signal output by the signal output terminal according to whether the output voltage value of the signal output terminal is within a preset interval range.

Preferably, the drive module is further configured to perform a comparison on the pulse width modulation signal and a preset reference square signal, and to adjust the state of the pulse width modulation signal output by the signal output terminal according to a result of the comparison.

Preferably, when the drive module adjusts the state of the pulse width modulation signal output by the signal output terminal according to a result of the comparison, when a pulse width of the pulse width modulation signal received by the drive module is larger than a pulse width of the preset reference square signal, the drive module adjusts a pulse width in a corresponding cycle of the pulse width modulation signal output by the signal output terminal to the pulse width of the preset reference square signal, and/or controls the signal output terminal to stop outputting the pulse width modulation signal;

or, when the pulse width of the pulse width modulation signal received by the drive module is larger than the pulse width of the preset reference square signal, the drive module outputs a control signal to the control chip, such that the control chip adjusts the state of the pulse width modulation signal output to the drive module.

Preferably, when the drive module adjusts a state of the pulse width modulation signal output by the signal output terminal according to whether the output voltage value of the signal output terminal is within a preset interval range, when the output voltage value of the signal output terminal is not within the preset interval range, the drive module controls the signal output terminal to stop outputting the pulse width modulation signal;

or, when the output voltage value of the signal output terminal is not within the preset interval range, the drive module outputs a control signal to the control chip, such that the control chip stops outputting the pulse width modulation signal.

Preferably, the control chip is an insulated gate bipolar transistor, a collector of the insulated gate bipolar transistor is configured as the first terminal, an emitter of the insulated gate bipolar transistor is configured as the second terminal, and a gate of the insulated gate bipolar transistor is configured as the control terminal.

Preferably, the drive module is further configured to detect a voltage between the collector and the emitter of the insulated gate bipolar transistor, to determine a work state of the insulated gate bipolar transistor according to a voltage between the collector and the emitter of the insulated gate bipolar transistor at a time when the insulated gate bipolar transistor is turned on, and to adjust a time period for the output voltage value of the signal output terminal to rise to a second preset value according to the work state.

In an embodiment of the present disclosure, the work state of the insulated gate bipolar transistor includes a start state, a hard turn-on state, and a normal state;

adjusting a time period for the output voltage value of the signal output terminal to rise to a second preset value according to the work state including:

when the work state is the start state, the time period for the output voltage value of the signal output terminal to rise to the second preset value is set to be a first threshold;

when the work state is the hard turn-on state, the time period for the output voltage value of the signal output terminal to rise to the second preset value is set to be a second threshold;

when the work state is the normal state, the time period for the output voltage value of the signal output terminal to rise to the second preset value is set to be a third threshold.

Preferably, a voltage detection terminal of the drive module is connected to the collector of the insulated gate bipolar transistor, a ground terminal of the drive module is connected to the emitter of the insulated gate bipolar transistor.

In addition, in order to achieve the above objective, embodiments of present disclosure provide an electronic device, including: an electromagnetic heating circuit. The electromagnetic heating circuit includes a control chip, a drive module, and a switch transistor, in which, the switch transistor includes a first terminal, a second terminal, and a control terminal configured to control a connection state between the first terminal and the second terminal, the control terminal is connected to a signal output terminal of the drive module;

the control chip is configured to output a pulse width modulation signal to the drive module, the pulse width modulation signal is output to the switch transistor via the signal output terminal of the drive module, so as to drive the switch transistor;

the drive module is configured to detect an output voltage value of the signal output terminal, and to adjust a state of the pulse width modulation signal output by the signal output terminal according to whether the output voltage value of the signal output terminal is within a preset interval range.

In embodiments of the present disclosure, by proving the drive module connected to the control chip and the switch transistor, the drive module controls the state of the pulse width modulation signal output by the signal output terminal according to the voltage of the signal output terminal, thus it is effectively prevented that the drive voltage of the switch transistor is so high to burn out the switch transistor, and that the drive voltage of the switch transistor is so low that the switch transistor cannot be turned on or in a magnifying state. Therefore, the electromagnetic the present disclosure improves stability of the switch transistor.

In order to achieve the above objective, embodiments of present disclosure provide an electromagnetic heating control circuit. The electromagnetic heating control circuit includes a switch transistor, a temperature detection module configured to detect a temperature of the switch transistor, a control chip configured to output a pulse width modulation signal, and a drive circuit configured to magnify the pulse width modulation signal and to output a magnified pulse width modulation signal to the switch transistor;

the switch transistor includes a first terminal, a second terminal, and a control terminal configured to control a connection state between the first terminal and the second terminal, the control terminal is connected to a signal output terminal of the drive circuit;

an output terminal of the temperature detection module is connected to the control chip;

the control chip is configured to obtain a temperature currently detected by the temperature detection module at first predetermined time intervals, to perform error correction on the currently detected temperature according to two temperatures detected twice in succession and a temperature compensation factor to calculate an actual temperature, and to control a work state of the switch transistor according to the actual temperature.

Preferably, the control chip is further configured to obtain a temperature currently detected by the temperature detection module at second predetermined time intervals, and to calculate a temperature compensation factor A corresponding to a difference between a temperature $X_n$ detected for $n^{th}$ time and a temperature $X_{n-1}$ detected for $(n-1)^{th}$ time according to the temperature $X_n$ and the temperature $X_{n-1}$, the temperature compensation factor A satisfies $$A = \frac{X_n(X_n - X_{n-1})^2}{KM},$$

in which, K is a constant, and M is an initial temperature for temperature compensation.

Preferably, when the control chip is configured to obtain a temperature currently detected by the temperature detection module at first predetermined time intervals, and to perform error correction on the currently detected temperature according to two temperatures detected twice in succession and a temperature compensation factor to calculate an actual temperature, the control chip is configured to obtain a temperature detected by the temperature detection module at first predetermined time intervals, to obtain a temperature compensation factor A corresponding to a difference between a temperature $X_m$ detected for current time and a temperature $X_{m-1}$ detected for last time according to the temperature $X_m$ and the temperature $X_{m-1}$, and to calculate the actual temperature $Y_m$ according to the temperature $X_m$, the temperature $X_{m-1}$, and the temperature compensation factor A, in which, $Y_m$ satisfies $Y_m=X_{m-1}+A(X_m-X_{m-1})$.

Preferably, the temperature detection module includes a temperature sensor, a thirty-first resistor, a thirty-second resistor and a thirty-first capacitor, one terminal of the thirty-first resistor is connected to a first preset power source, and the other terminal of the thirty-first resistor is connected to a ground terminal via the temperature sensor; one terminal of the thirty-second resistor is connected to a common terminal of the thirty-first resistor and the temperature sensor, and the other terminal of the thirty-second resistor is connected to a ground terminal via the thirty-first capacitor, and a common terminal of the thirty-second resistor and the thirty-first capacitor is connected to a temperature collecting terminal of the control chip.

Preferably, the drive circuit includes a drive integrated chip, a thirty-third resistor, a fifteenth resistor, a sixteenth resistor, a seventeenth resistor, and a thirty-second capacitor, in which, a pulse width modulation signal input terminal of the drive integrated chip is connected to the control chip via the thirty-third resistor, a drive voltage input terminal of the drive integrated chip is connected to a second preset power source, a pulse width modulation signal output terminal of the drive integrated chip is connected to the control terminal of the switch transistor via the sixteenth resistor; one terminal of the fifteenth resistor is connected to the second preset power source, and the other terminal of the fifteenth resistor is connected to a common terminal of the thirty-third resistor and the control chip; one terminal of the sixteenth resistor is connected to the control terminal of the switch transistor, and the other terminal of the sixteenth resistor is connected to the second terminal of the switch transistor; one terminal of the thirty-second capacitor is connected to the drive voltage input terminal, and the other terminal of the thirty-second capacitor is connected to a ground terminal.

Preferably, the drive circuit further includes a Zener diode, an anode of the Zener diode is connected to the second terminal of the switch transistor, and a cathode of the Zener diode is connected to the control terminal of the switch transistor.

Preferably, the switch transistor is an insulated gate bipolar transistor, a collector of the insulated gate bipolar transistor is configured as the first terminal, an emitter of the insulated gate bipolar transistor is configured as the second terminal, and a gate of the insulated gate bipolar transistor is configured as the control terminal.

Preferably, the electric heating drive protection circuit further includes a buzzer circuit, in which the buzzer circuit is connected to the control chip.

By providing the temperature detection module configured to detect the temperature of the switch transistor, and controlling the work state of the switch transistor according to the detected temperatures and the preset temperature compensation factor, the electromagnetic heating control circuit provided by embodiments of the present disclosure can prevent the switch transistor from being burnt out due to high temperature. Thus the present disclosure improves the stability of circuit operation.

In order to achieve the above objective, embodiments of present disclosure provide a surge protection circuit, including a first voltage division circuit including a resistor and a capacitor, a rectifying circuit configured to perform rectification on mains supply, and a control circuit configured to perform surge protection; the control circuit includes a first comparator;

an input terminal of the first voltage division circuit is connected to an output terminal of the rectifying circuit, an output terminal of the first voltage division circuit is connected to a first input terminal of the first comparator; a second input terminal of the first comparator is connected to a preset first reference power source, and when a voltage of the mains supply is lower than a first preset value, if there is positive surge, a voltage of the output terminal of the first voltage division circuit is higher than a voltage of the preset first reference power source, if there is no positive surge, the voltage of the output terminal of the first voltage division circuit is lower than the voltage of the preset first reference power source; the control circuit performs surge protection control according a state of an output level of an output terminal of the first comparator.

Preferably, the first voltage division circuit includes a first resistor, a second resistor, and a first capacitor, one terminal of the first resistor is connected to the output terminal of the rectifying circuit, and the other terminal of the first resistor is connected to a ground terminal via the second resistor; the first capacitor is connected in parallel to two terminals of the second resistor; the first input terminal of the first comparator is connected to a common terminal of the first resistor and the second resistor.

Preferably, the surge protection circuit further includes a second voltage division circuit including a resistor and a capacitor, and a third voltage division circuit, the control circuit further includes a second comparator and a third comparator;

an input terminal of the second voltage division circuit is connected to the output terminal of the rectifying circuit, an output terminal of the second voltage division circuit is connected to a first input terminal of the second comparator, a second input terminal of the second comparator is connected to the output terminal of the first voltage division circuit; when there is no positive surge voltage in the mains supply, the voltage of the output terminal of the first voltage division circuit is higher than a voltage of the output terminal of the second voltage division circuit; when there is a positive surge voltage in the mains supply, the voltage of the output terminal of the first voltage division circuit is lower than the voltage of the output terminal of the second voltage division circuit;

an input terminal of the third voltage division circuit is connected to the output terminal of the rectifying circuit, an output terminal of the third voltage division circuit is connected to a first input terminal of the third comparator, a second input terminal of the third comparator is connected to a preset second reference power source, configured to detect a zero-crossing point of the mains supply, and to control an output terminal of the second comparator to output a preset level signal when a voltage of the output terminal of the third voltage division circuit is lower than a second preset value.

Preferably, the second voltage division circuit includes a third resistor, a fourth resistor, and a second capacitor, one terminal of the third resistor is connected to the output terminal of the rectifying circuit, and the other terminal of the third resistor is connected to a ground terminal via the fourth resistor; the second capacitor is connected in parallel to two terminals of the fourth resistor; the first input terminal of the second comparator is connected to a common terminal of the third resistor and the fourth resistor.

Preferably, the third voltage division circuit includes a fifth resistor, a sixth resistor, a seventh resistor, a third capacitor, and a fourth capacitor, one terminal of the fifth resistor is connected to the output terminal of the rectifying circuit, and the other terminal of the fifth resistor is connected to a ground terminal via a serial connection of the sixth resistor and the seventh resistor; the third capacitor is connected in parallel to two terminals of the fifth resistor; the fourth capacitor is connected in parallel to two terminals of the seventh resistor; the first input terminal of the third comparator is connected to a common terminal of the sixth resistor and the seventh resistor.

Preferably, the surge protection circuit further includes a fourth voltage division circuit including a resistor and a capacitor, the control circuit further includes a fourth comparator;

an input terminal of the fourth voltage division circuit is connected to the output terminal of the rectifying circuit, an output terminal of the fourth voltage division circuit is connected to a first input terminal of the fourth comparator, a second input terminal of the fourth comparator is connected to the output terminal of the second voltage division circuit; when there is no negative surge voltage in the mains supply, a voltage of the output terminal of the fourth voltage division circuit is lower than the voltage of the output terminal of the second voltage division circuit; when there is a negative surge voltage in the mains supply, the voltage of the output terminal of the fourth voltage division circuit is higher than the voltage of the output terminal of the second voltage division circuit;

the third comparator is further configured to control an output terminal of the fourth comparator to output a preset level signal when the voltage of the output terminal of the third voltage division circuit is lower than the second preset value.

Preferably, the fourth voltage division circuit includes an eighth resistor, a ninth resistor, and a fifth capacitor, one terminal of the eighth resistor is connected to the output terminal of the rectifying circuit, and the other terminal of the eighth resistor is connected to a ground terminal via the ninth resistor; the fifth capacitor is connected in parallel to two terminals of the ninth resistor; the first input terminal of the fourth comparator is connected to a common terminal of the eighth resistor and the ninth resistor.

Preferably, the rectifying circuit includes a first diode and a second diode, an anode of the first diode is connected to a first alternating current input terminal of the mains supply, the second diode is connected to a second alternating current input terminal of the mains supply, a cathode of the first diode is connected to a cathode of the second diode.

In embodiments of the present disclosure, after the mains supply is rectified by the rectifying circuit, voltage division is performed by the first voltage division circuit, and a comparison is performed on divided voltage and the first reference voltage, and it is determined whether there is a positive surge voltage in a period when the mains supply is close to the zero-crossing point according a result of the comparison, if there is a positive surge voltage, the control circuit performs the surge protection. The present disclosure realizes surge detection in the period when the mains supply is close to the zero-crossing point, so as to prevent the surge phenomenon at the zero-crossing point from damaging the electrical equipment, thus improving security for power supply.

The realization of objectives, functional features and advantages of the present disclosure will be further described with reference to the accompanying drawings in combination with the embodiment.

DETAILED DESCRIPTION

It should be understood that, the embodiments described herein are used to explain the present disclosure, and shall not be construed to limit the present disclosure.

Figure 1:
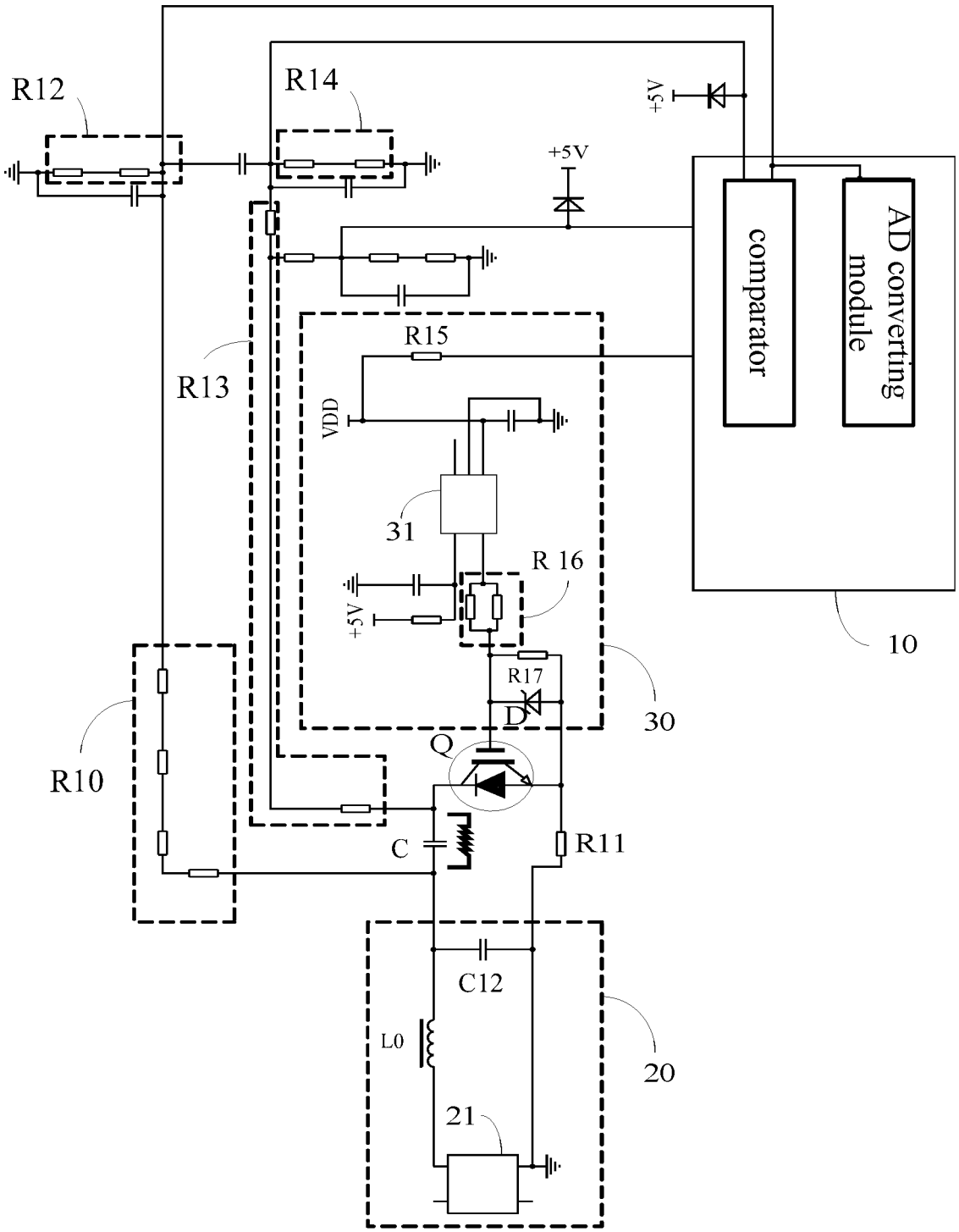
FIG. 1 is a schematic diagram showing a structure of an electromagnetic heating control circuit according to an embodiment of the present disclosure.

Embodiments of the present disclosure provide an electromagnetic heating control circuit. As illustrated in FIG. 1, in an embodiment, the electromagnetic heating control circuit includes a control chip 10, a rectifying and filtering circuit 20, a resonance capacitor C, a switch transistor Q, a drive circuit 30, and a synchronous voltage detection circuit.

The switch transistor Q includes a first terminal, a second terminal, and a control terminal configured to control a connection state between the first terminal and the second terminal. The first terminal is connected to a positive output terminal of the rectifying and filtering circuit 20 via the resonance capacitor C. The second terminal is connected to a negative output terminal of the rectifying and filtering circuit 20 via a current-limiting resistor R11.

The control chip 10 includes a non-inverting voltage input terminal, an inverting voltage input terminal, a voltage detection terminal, and a signal output terminal. The non-inverting voltage input terminal and the inverting voltage input terminal detect voltages at two terminals of the resonance capacitor C via the synchronous voltage detection circuit. The signal output terminal is connected to the control terminal via the drive circuit 30. The voltage detection terminal is connected to the positive output terminal of the rectifying and filtering circuit 20 via the synchronous voltage detection circuit. The control chip 10 controls a work state of the switch transistor Q according to a voltage detected by the voltage detection terminal, and the control chip 10 controls, according to voltages at the non-inverting voltage input terminal and the inverting voltage input terminal, the switch transistor Q to turn on when a voltage at a connection node between the resonance capacitor C and the switch transistor Q is zero. In embodiments of the present disclosure, the control chip 10 obtains a state of current mains supply voltage according to a voltage detected by the voltage detection terminal, so as to further control power of an electromagnetic heating apparatus.

The electromagnetic heating control circuit provided in this embodiment is mainly applied in an electromagnetic heating device. For example, the electromagnetic heating device may be applied to an induction cooker, an electric cooker, an electric pressure cooker, a soybean milk machine, an electric kettle and the like. The control chip 10 is provided with a comparator and an AD conversion module. Two input terminals of the comparator are configured as the non-inverting voltage input terminal and the inverting voltage input terminal. An input terminal of the AD conversion module is configured as the voltage detection terminal. It should be noted that, the resonance capacitor C is connected in parallel with an electromagnetic coil panel to form a parallel resonant circuit.

The synchronous voltage detection circuit is configured to detect voltages at two terminals of the resonance capacitor C, such that the control chip 10 controls the switch transistor Q to turn on when the voltages at two terminals of the resonance capacitor C are equal, thus realizing zero-crossing conduction. An input terminal of the rectifying and filtering circuit 20 is connected to mains supply grid. As a voltage of an input terminal of the rectifying and filtering circuit 20 is proportional to a voltage of an output terminal of the rectifying and filtering circuit 20, the voltage of the input terminal of the rectifying and filtering circuit 20 can be obtained by detecting the voltage of the output terminal of the rectifying and filtering circuit 20. Therefore, power control and under-voltage and over-voltage protection of mains supply can be realized according to the voltage of the output terminal of the rectifying and filtering circuit 20.

In embodiments of the present disclosure, by directly connecting the voltage detection terminal of the control chip 10 to the output terminal of the rectifying and filtering circuit 20, that is, connecting the voltage detection terminal of the control chip 10 to the output terminal of the rectifying and filtering circuit via a first voltage sampling circuit of the synchronous circuit, power control and under-voltage and over-voltage protection of mains supply can be realized according to the voltage of the output terminal of the rectifying and filtering circuit 20. Relative to providing a voltage sampling circuit at the input terminal of the rectifying and filtering circuit 20 to detect the voltage of the input terminal of the rectifying and filtering circuit 20 in the related art, the present disclosure detects the voltage of the output terminal of the rectifying and filtering circuit 20 using the synchronous voltage detection circuit and performs the power control and the under-voltage and over-voltage protection of mains supply, thus reducing cost and power consumption of circuit design.

Based on above embodiments, in this embodiment, the synchronous voltage detection circuit includes a first voltage sampling circuit and a second voltage sampling circuit. One terminal of the first voltage sampling circuit is connected to the positive output terminal of the rectifying and filtering circuit 20, and the other terminal of the first voltage sampling circuit is connected to the non-inverting voltage input terminal. One terminal (i.e. an input terminal) of the second voltage sampling circuit is connected to the first terminal of the switch transistor Q, and the other terminal (i.e. an output terminal) of the second voltage sampling circuit is connected to the inverting voltage input terminal. The control chip 10 controls, according to the voltages at the non-inverting voltage input terminal and the inverting voltage input terminal, the switch transistor Q to turn on when a difference between voltages at two terminals of the resonance capacitor C1 is zero.

Structures of the first voltage sampling circuit and the second voltage sampling circuit can be set according to actual requirement. In an embodiment, the first voltage sampling circuit includes a tenth resistor R10 and a twelfth resistor R12. One terminal of the tenth resistor R10 is connected to the positive output terminal of the rectifying and filtering circuit 20, and the other terminal of the tenth resistor R10 is connected to the negative output terminal of the rectifying and filtering circuit 20 via the twelfth resistor R12. The negative output terminal of the rectifying and filtering circuit 20 is grounded. A common terminal of the tenth resistor R10 and the twelfth resistor R12 is connected to the non-inverting voltage input terminal. The second voltage sampling circuit includes a thirteenth resistor R13 and a fourteenth resistor R14. One terminal of the thirteenth resistor R13 is connected to the first terminal of the switch transistor Q, and the other terminal of the thirteenth resistor R13 is connected to the negative output terminal of the rectifying and filtering circuit 20 via the fourteenth resistor R14. The negative output terminal of the rectifying and filtering circuit 20 is grounded. A common terminal of the thirteenth resistor R13 and the fourteenth resistor R14 is connected to the non-inverting voltage input terminal.

It should be noted that, resistances and structures of the tenth resistor R10, the twelfth resistor R12, the thirteenth resistor R13, and the fourteenth resistor R14 can be set according to actual requirement, as long as a zero-crossing point of current of the first terminal of the switch transistor Q can be detected. In an embodiment, each of the tenth resistor R10, the twelfth resistor R12, the thirteenth resistor R13, and the fourteenth resistor R14 is composed of at least of two resistors in series.

The drive circuit 30 includes a drive chip 31, a fifteenth resistor R15, a sixteenth resistor R16, and a seventeenth resistor R17. A drive input terminal of the drive chip 31 is connected to the signal output terminal via the fifteenth resistor R15, and the drive input terminal is connected to a preset power source VDD. A drive output terminal of the drive chip 31 is connected to the second terminal of the switch transistor Q via a serial connection of the sixteenth resistor R16 and the seventeenth resistor R17. A common terminal of the sixteenth resistor R16 and the seventeenth resistor R17 is connected to the control terminal of the switch transistor Q.

In an embodiment, the signal output terminal of the control chip 10 is configured to output a pulse width modulation signal to the drive input terminal of the drive chip 31. Voltage and current magnification is performed on the pulse width modulation signal via the preset supply source VDD and the fifteenth resistor R15, and a magnified pulse width modulation signal is output via the drive output terminal. After voltage division is performed by the sixteenth resistor R16 and the seventeenth resistor R17 on the magnified pulse width modulation signal output by the drive output terminal, a turn-on or a turn-off state of the switch transistor Q is controlled according to a voltage value across the seventeenth resistor R17.

It should be noted that, a type of the drive chip 31 can be set according to actual requirement, as long as a level output to the control terminal of the switch transistor Q after the voltage and current magnification of the pulse width modulation signal can turn on the switch transistor Q. A specific structure of the switch transistor Q can be set according to actual requirement. In an embodiment, the switch transistor Q is an insulated gate bipolar transistor (IGBT for short), a collector of the IGBT is configured as the first terminal, an emitter of the IGBT is configured as the second terminal, and a gate of the IGBT is configured as the control terminal.

Further, in an embodiment, in order to prevent a drive voltage of the gate of the IGBT from being so high to damage the IGBT, a protection device is provided. In this embodiment, the drive circuit further includes a Zener diode D. A cathode of the Zener diode D is connected to the control terminal, and an anode of the Zener diode D is connected to the second terminal of the switch transistor Q.

In an embodiment, by providing the Zener diode D between the gate and the emitter of the IGBT, a voltage between the gate and the emitter of the IGBT is not higher than a regulated voltage of the Zener diode when the pulse width modulation signal is a high level.

The rectifying and filtering circuit 20 includes a bridge rectifier 21, an inductor L0 and a capacitor C12. A positive output terminal of the bridge rectifier 21 is connected to the resonance capacitor C12 via the inductor L0, and a negative output terminal of the bridge rectifier 21 is connected to the second terminal of the switch transistor Q via the current-limiting resistor R11. One terminal of the capacitor C12 is connected to a common terminal of the inductor L0 and resonance capacitor C, and the other terminal of the capacitor C12 is connected to the negative output terminal of the bridge rectifier 21.

Figure 2:
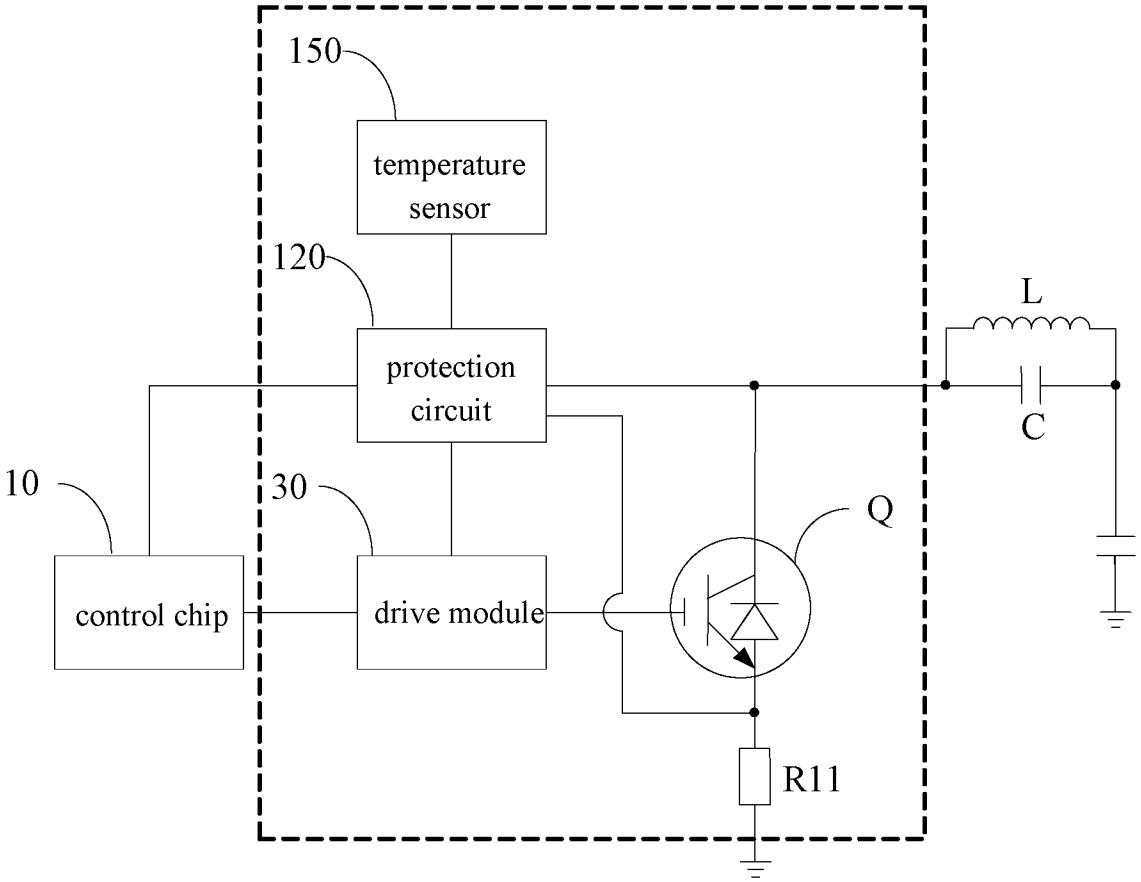
FIG. 2 is a schematic diagram showing a connection structure of an electromagnetic heating control circuit according to a first embodiment of the present disclosure.

Embodiments of the present disclosure provide an electromagnetic heating control circuit. As illustrated in FIG. 2, in an embodiment, the electromagnetic heating control circuit includes a drive circuit 30, a protection circuit 120 and a switch transistor Q.

The switch transistor Q has a first terminal, a second terminal, and a control terminal configured to control a connection state between the first terminal and the second terminal. The control terminal is connected to a signal output terminal of the drive circuit, and the second terminal is connected to a ground terminal.

The drive circuit 30 is connected to a control chip 10. The drive circuit 30 magnifies a pulse width modulation signal received from the control chip 10, and outputs a magnified pulse width modulation signal to the switch transistor Q via the signal output terminal of the drive circuit 30, so as to drive the switch transistor Q.

The drive circuit 30 is configured to detect an output voltage value of the signal output terminal, and to adjust a state of the magnified pulse width modulation signal output by the signal output terminal according to whether the output voltage value of the signal output terminal is within a preset interval range.

The protection circuit 120 is configured to control a work state of the switch transistor Q according to a voltage value of the first terminal when the switch transistor Q is turned off, or the protection circuit 120 is configured to control the work state of the switch transistor Q according to a detected current value of the second terminal when the switch transistor Q is turned on.

The drive circuit provided in this embodiment is configured to realize drive controlling of the switch transistor Q. Structure of the switch transistor Q can be set according to actual requirement. In an embodiment, the switch transistor Q is an IGBT. A collector of the IGBT is configured as the first terminal, an emitter of the IGBT is configured as the second terminal, and a gate of the IGBT is configured as the control terminal.

The first terminal of the switch transistor Q is connected to a parallel resonant circuit. The parallel resonant circuit includes a coil L and a resonance capacitor C. When the switch transistor Q is turned off, the coil L and the resonance capacitor C enter an energy storage state, with electric energy rising. At this time, a voltage between the first terminal and the second terminal of the switch transistor Q rises. When the switch transistor Q is turned on, energy stored in the coil L and the resonance capacitor C is released, so as to reduce the voltage between the first terminal and the second terminal of the switch transistor Q, and prevent the voltage between the first terminal and the second terminal of the switch transistor Q from being so high to damage the switch transistor Q after the switch transistor Q is turned off.

In this embodiment, for preventing the voltage between the first terminal and the second terminal of the switch transistor Q from being too high, a voltage value of the first terminal when the switch transistor Q is turned off can be detected, or a current value of the second terminal when the switch transistor Q is turned on can be detected.

When the voltage value of the first terminal at a time when the switch transistor Q is turned off is detected, if the voltage value of the first terminal is higher than a preset voltage when the switch transistor Q is turned off, the switch transistor Q is controlled to be turned on, so as to prevent from damaging the switch transistor Q due to a high voltage between the first terminal and the second terminal.

In this embodiment, a maximum voltage after the switch transistor Q is turned off can be estimated according to the current value of the second terminal of the switch transistor Q. When detecting the current value of the second terminal at a time when the switch transistor Q is turned on, if the current value of the second terminal is larger than a preset value when the switch transistor Q is turned on, the switch transistor Q is controlled to be turned off, so as to prevent the voltage from rising too high to damage the switch transistor Q after the switch transistor Q is turned off.

The drive circuit 30 adjusts the state of the pulse width modulation signal output by the signal output terminal according to the output voltage value of the signal output terminal as follows. When the output voltage value of the signal output terminal is not within the preset interval range, the drive circuit 30 controls the signal output terminal to stop outputting the pulse width modulation signal. Alternatively, when the output voltage value of the signal output terminal is not within the preset interval range, the drive circuit 30 outputs a control signal to the control chip 10, such that the control chip 10 stops outputting the pulse width modulation signal.

The preset interval range can be set according to actual requirement, which is not limited herein, as long as the switch transistor can be driven to prevent the switch transistor from being burned out.

It should be noted that, the drive circuit 30 can use a built-in voltage sampling circuit to detect a voltage of a signal input terminal, or use a comparator to determine the voltage of the first terminal, specific circuit arrangement can be set according to actual requirement, which is not limited herein. It can be understood that, when the output voltage value of the signal output terminal is not within the preset interval range, the output voltage value of the signal output terminal of the drive circuit 30 can be adjusted by the control chip 10 or the drive circuit 30, such that the output voltage value of the signal output terminal maintains within the preset interval range. The output voltage of the signal output terminal is a drive voltage of the gate of the IGBT. For example, when the drive voltage of the gate of the IGBT is larger than an upper limit value of the preset interval range, the drive circuit 30 can stop outputting the pulse width modulation signal to the gate of the IGBT, i.e., pulling down the voltage of the gate of the IGBT. Thus, it is prevented that the drive voltage of the gate of the IGBT is so high to damage the IGBT.

In embodiments of the present disclosure, by providing the protection circuit 120, the work state of the switch transistor Q is controlled according to the voltage value of the first terminal when the switch transistor Q is turned off, or the work state of the switch transistor Q is controlled according to current value of the second terminal when the switch transistor Q is turned on, thus it is effectively prevented that the voltage between the first terminal and the second terminal is so high to damage the switch transistor Q when the switch transistor Q is turned off. In addition, the drive circuit 30 controls the state of the pulse width modulation signal output by the signal output terminal according to a voltage of signal output terminal, thus it is effectively prevented that the drive voltage of the switch transistor Q is so high to burn out the switch transistor Q and that the drive voltage of the switch transistor Q is so low that the switch transistor Q cannot be turned on or in a magnifying state.

Therefore, the electromagnetic heating control circuit provided in the present disclosure improves stability of circuit operation.

Further, based on the above embodiments, in a second embodiment, the drive circuit 30 is further configured to perform a comparison on the received pulse width modulation signal and a preset reference square signal, and to adjust the state of the pulse width modulation signal output by the signal output terminal according to a result of the comparison.

In an embodiment, the reference square signal can be generated by the control chip 30, or be generated by a square signal generating circuit. A pulse width of the reference square signal is a maximum pulse width allowed to be output.

When a pulse width of the pulse width modulation signal received by the drive circuit 30 is larger than a pulse width of the reference square signal, the drive circuit 30 adjusts a pulse width in a corresponding cycle of the pulse width modulation signal output by the signal output terminal to the pulse width of the reference square signal, and/or controls the signal output terminal to stop outputting the pulse width modulation signal.

Alternatively, when the pulse width of the pulse width modulation signal received by the drive circuit 30 is larger than the pulse width of the reference square signal, the drive circuit 30 outputs a control signal to the control chip 10, such that the control chip 10 adjusts the state of the pulse width modulation signal output to the drive circuit 30.

In this embodiment, by limiting the duty ratio of the pulse width modulation signal, phenomenon such as over-current, over-voltage, overheating, and the like of the IGBT due to long conducting time of the IGBT can be avoided, thus improving security for using the IGBT.

Further, based on above embodiments, in a third embodiment, the drive circuit 30 is further configured to detect a voltage between the collector and the emitter of the insulated gate bipolar transistor, to determine a work state of the insulated gate bipolar transistor according to a voltage between the collector and the emitter of the insulated gate bipolar transistor at a time when the insulated gate bipolar transistor is turned on, and to adjust a time period for the output voltage value of the signal output terminal to rise to a second preset value according to the work state.

It should be noted that, a voltage detection terminal of the drive circuit 30 is connected to the collector of the IGBT, and a ground terminal of the drive circuit 30 is connected to the emitter of the IGBT, thus the voltage between the collector and the emitter of IGBT can be detected.

The work state of the insulated gate bipolar transistor includes a start state, a hard turn-on state, and a normal state.

Adjusting a time period for the output voltage value of the signal output terminal to rise to a second preset value according to the work state includes follows.

When the work state is the start state, the time period for the output voltage value of the signal output terminal to rise to the second preset value is set to be a first threshold.

When the work state is the hard turn-on state, the time period for the output voltage value of the signal output terminal to rise to the second preset value is set to be a second threshold.

When the work state is the normal state, the time period for the output voltage value of the signal output terminal to rise to the second preset value is set to be a third threshold.

In this embodiment, a current peak value of the IGBT may be very large in following two situations. One is a hard-on/off caused by leading conduction (i.e. the IGBT is turned on when Vce of the IGBT has not reached 0) of the IGBT, and the other one is that a resonant capacitance rises sharply from 0 to a DC bus voltage (to be 311V under a condition of 220V) in a first cycle after the IGBT is turned on.

Based on above embodiments, different detection modes are described in detail in the following.

In a fourth embodiment, when the protection circuit 120 is configured to control the work state of the switch transistor Q according to the voltage value of the first terminal when the switch transistor Q is turned off, the protection circuit 120 includes a voltage sampling circuit and a comparator. The voltage sampling circuit includes a first resistor and a second resistor. One terminal of the first resistor is connected to the first terminal, and the other terminal of the first resistor is connected to the ground terminal via the second resistor. A non-inverting input terminal of the comparator is connected to a common terminal of the first resistor and the second resistor, an inverting input terminal of the comparator is connected to a preset reference voltage terminal, and an output terminal of the comparator is connected to the control terminal.

In this embodiment, when the switch transistor Q is turned off, and when a voltage across two terminals of the second resistor is lower than a preset reference voltage of the preset reference voltage terminal (i.e., a voltage between the first terminal and the second terminal is lower than a preset voltage), the switch transistor Q may keep a turn-off state according to the pulse width modulation signal output by the signal output terminal. When the voltage across two terminals of the second resistor is higher than the preset reference voltage of the preset reference voltage terminal (i.e., the voltage between the first terminal and the second terminal is higher than the preset voltage), the comparator may output a high level, thus turning on the switch transistor Q, and releasing the energy stored in the coil L and the resonance capacitor C.

In a fifth embodiment, when the protection circuit 120 is configured to control the work state of the switch transistor Q according to the voltage value of the first terminal when the switch transistor Q is turned off, the protection circuit 120 includes a voltage sampling circuit and a comparator. The voltage sampling circuit includes a first resistor and a second resistor. One terminal of the first resistor is connected to the first terminal, and the other terminal of the first resistor is connected to the ground terminal via the second resistor. A non-inverting input terminal of the comparator is connected to a common terminal of the first resistor and the second resistor, an inverting input terminal of the comparator is connected to a preset reference voltage terminal, and an output terminal of the comparator is connected to the drive circuit 30.

When a voltage of the first terminal is higher than the preset reference voltage, the comparator outputs a control signal to the drive circuit 30. The drive circuit 30 controls the signal output terminal of the drive circuit 30 to output a preset level signal according to the control signal, so as to turn on the switch transistor Q.

In this embodiment, when the switch transistor Q is turned off, and when a voltage across two terminals of the second resistor is lower than the preset reference voltage of the preset reference voltage terminal (i.e., a voltage between the first terminal and the second terminal is lower than the preset voltage), the switch transistor Q may keep a turn-off state according to the pulse width modulation signal output by the signal output terminal. When the voltage across two terminals of the second resistor is higher than the preset reference voltage of the preset reference voltage terminal (i.e., the voltage between the first terminal and the second terminal is higher than a preset voltage), the comparator may output a high level signal to the drive circuit 30, such that drive circuit 30 controls the signal output terminal of the drive circuit 30 to output a high level signal, thus turning on the switch transistor Q, and releasing the energy stored in the coil L and the resonance capacitor C.

In a sixth embodiment, when the protection circuit 120 is configured to control the work state of the switch transistor Q according to the voltage value of the first terminal when the switch transistor Q is turned off, the protection circuit 120 includes a voltage sampling circuit and a comparator. The voltage sampling circuit includes a first resistor and a second resistor. One terminal of the first resistor is connected to the first terminal, and the other terminal of the first resistor is connected to the ground terminal via the second resistor. A non-inverting input terminal of the comparator is connected to a common terminal of the first resistor and the second resistor, an inverting input terminal of the comparator is connected to a preset reference voltage terminal, and an output terminal of the comparator is connected to the control chip 10.

When a voltage value of the first terminal is higher than the preset reference voltage, the comparator outputs a control signal to the control chip 10, such that the control chip 10 adjusts a duty ratio of the pulse width modulation signal output to the drive circuit 30.

In this embodiment, the duty ratio of the pulse width modulation signal output to the drive circuit 30 is changed by the control chip 10, such that the voltage value between the first terminal and the second terminal is limited during a period in which the switch transistor Q is turned off, and it is prevented that the switch transistor Q is damaged due to a high voltage between the first terminal and the second terminal during a period in which the switch transistor Q is turned off, thus extending using life of the switch transistor Q.

In a seventh embodiment, when the protection circuit 120 is configured to control the work state of the switch transistor Q according to a detected current value of the second terminal when the switch transistor Q is turned on, the electromagnetic heating control circuit further includes a current-limiting resistor R11 connected in series between the second terminal and the ground terminal, and a voltage detection terminal of the protection circuit 120 is connected to the second terminal so as to detect the current value of the second terminal.

Figure 3:
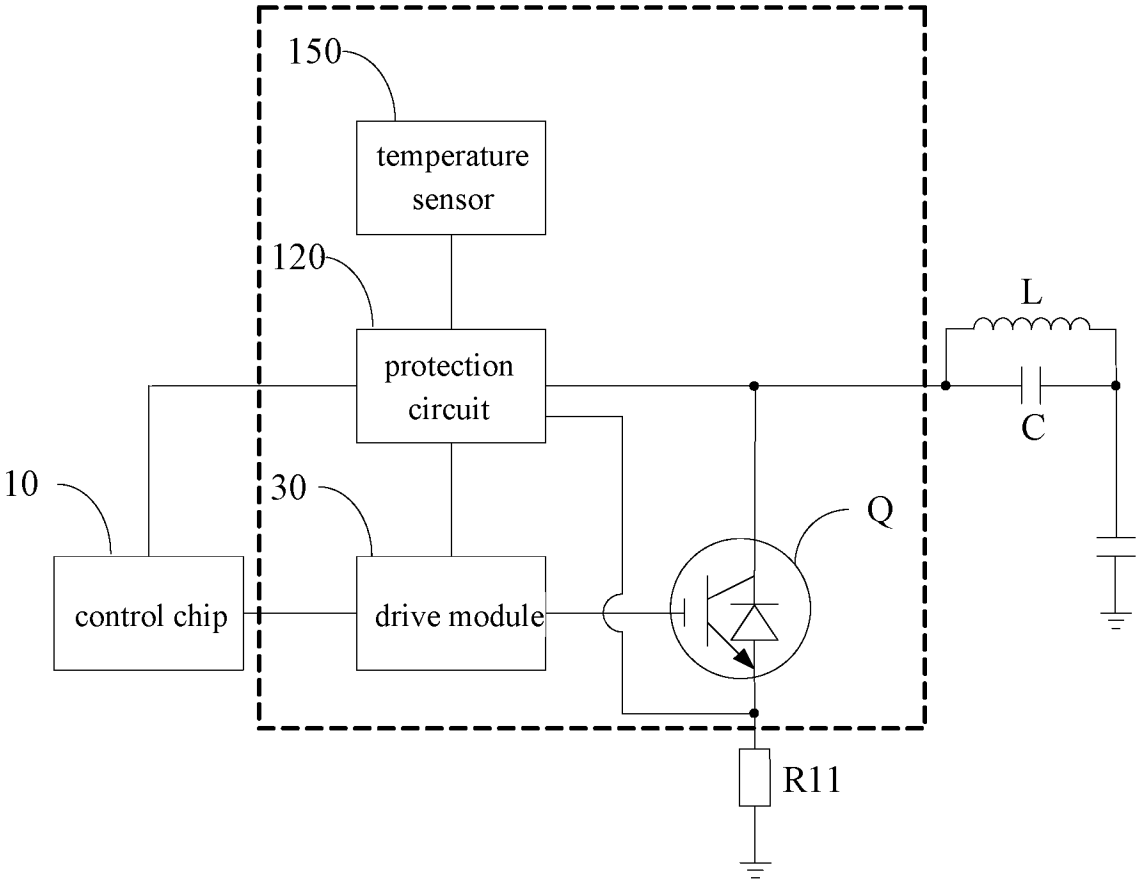
FIG. 3 is a schematic diagram showing a connection structure of an electromagnetic heating control circuit according to a second embodiment of the present disclosure.

In this embodiment, the protection circuit 120 can obtain a current flowing through the current-limiting resistor R11 (a current value of the second terminal of the switch transistor Q) according to a voltage value detected by the voltage detection terminal. Then, a maximum voltage between the first terminal and the second terminal after the switch transistor Q is turned off is estimated according to the current value of the second terminal. When the current flowing through the current-limiting resistor R11 makes the maximum voltage higher than the preset voltage, the switch transistor Q is controlled to be turned off, so as to ensure that the maximum voltage between the first terminal and the second terminal is lower than the preset voltage after the switch transistor Q is turned off, thus preventing from damaging the switch transistor Q. At this time, the current flowing through the current-limiting resistor R11 is a maximum current allowed to be flowed through when the switch transistor Q is turned on, which may be called as a preset value hereinafter. It should be noted that, the current-limiting resistor R11 can be a built-in resistor of the electromagnetic heating control circuit, and can be a peripheral resistor in specific applications (as illustrated in FIG. 3).

It can be understood that, a state of level output by the signal output terminal of the drive circuit 10 can be controlled by the drive circuit 30, or can be controlled by controlling the pulse width modulation signal output to the drive circuit 10 from the control chip 10, specific implementation mode of which can be set according to actual requirement, and no further limitations are made here.

Based on the seventh embodiment, in one embodiment, the protection circuit 120 is connected to the drive circuit 10. When the current value of the second terminal is detected to be higher than a preset value, a control signal is output to the drive circuit 30, such that the drive circuit 30 controls the signal output terminal to output a preset level signal, to turn off the switch transistor Q.

In another embodiment, the protection circuit 120 is connected to the control chip 10. When the current value of the second terminal is detected to be higher than a preset value, the control signal is output to the control chip 10, such that the control chip 10 adjusts a duty ratio of the pulse width modulation signal output to the drive circuit 30.

It can be understood that, in the circuit design, any one of the above two implementation modes can be used, and the control signal can also be output to both the drive circuit 30 and the control chip 10 by the protection circuit 120. That is the signal output terminal of the protection circuit 120 can be connected to both the drive circuit 30 and the control chip 10.

Further, based on any one of the above embodiments, the electromagnetic heating control circuit further includes a temperature sensor 150 configured to detect a temperature of the switch transistor Q. The temperature sensor 150 is connected to the protection circuit 120. The protection circuit 120 is configured to output a control signal to the drive circuit 30 or to the control chip 10 according to the temperature detected by the temperature sensor 150, such that the drive circuit 30 or the control chip 10 adjusts a duty ratio of the pulse width modulation signal output by the signal output terminal according to the control signal.

In embodiments of the present disclosure, the protection circuit 120 detects the temperature of the switch transistor Q via the temperature sensor 150, sends the temperature of the switch transistor Q to the drive circuit 30 or to the control chip 10, and the duty ratio of the pulse width modulation signal is adjusted by the drive circuit 30 or the control chip 10 according to the temperature, thus realizing operations such as reducing power, improving power, turning off the switch transistor Q, and the like.

Figure 4:
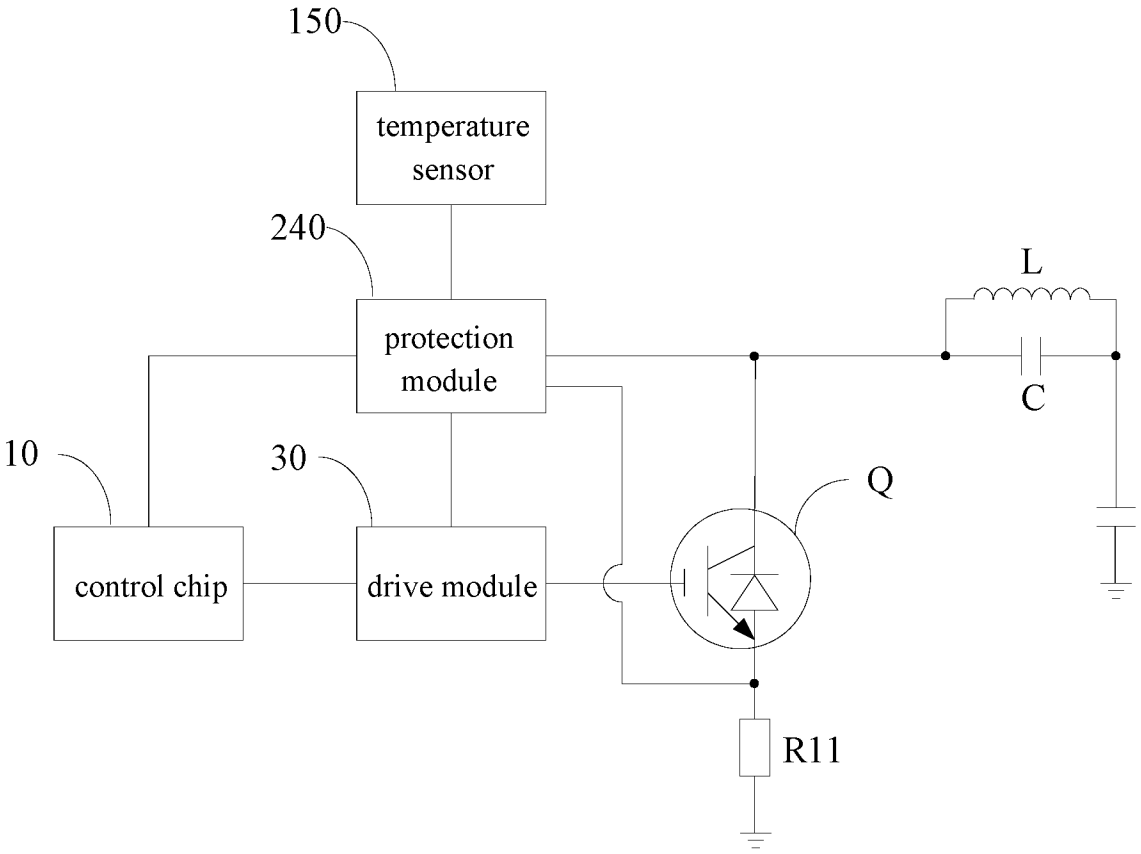
FIG. 4 is a schematic diagram showing a structure of an electromagnetic heating circuit according to an embodiment of the present disclosure.

The present disclosure provides an electromagnetic heating circuit, as illustrated in FIG. 4. In one embodiment, the electromagnetic heating circuit includes a coil L, a resonance capacitor C, a control chip 10, a drive module 30, a protection module 240, and a switch transistor Q.

The coil L is connected in parallel to the resonance capacitor C.

The switch transistor Q includes a first terminal, a second terminal, and a control terminal configured to control a connection state between the first terminal and the second terminal. The control terminal is connected to a signal output terminal of the drive module 30. The first terminal is connected to a terminal of the resonance capacitor C. The second terminal is connected to a ground terminal.

The control chip 10 is configured to output a pulse width modulation signal to the drive module 30. The pulse width modulation signal is output to the switch transistor Q via the signal output terminal of the drive module 30, so as to drive the switch transistor Q.

The protection module 240 is configured to control a work state of the switch transistor Q according to a voltage value of the first terminal when the switch transistor Q is turned off, or the protection module 240 is configured to control the work state of the switch transistor Q according to a detected current value of the second terminal when the switch transistor Q is turned on.

The drive circuit provided in this embodiment is configured to realize drive controlling of the switch transistor Q. Structure of the switch transistor Q can be set according to actual requirement. In an embodiment, the switch transistor Q is an IGBT. A collector of the IGBT is configured as the first terminal, an emitter of the IGBT is configured as the second terminal, and a gate of the IGBT is configured as the control terminal.

When the switch transistor Q is turned off, the coil L and the resonance capacitor C enter a resonant state, with electric energy rising. At this time, a voltage between the first terminal and the second terminal of the switch transistor Q rises. When the switch transistor Q is turned on, energy stored in the coil L and the resonance capacitor C is released, so as to reduce the voltage between the first terminal and the second terminal of the switch transistor Q, and prevent the high voltage between the first terminal and the second terminal of the switch transistor Q from damaging the switch transistor Q after the switch transistor Q is turned off.

In this embodiment, for preventing the voltage between the first terminal and the second terminal of the switch transistor Q from being too high, a voltage value of the first terminal when the switch transistor Q is turned off can be detected, or a current value of the second terminal when the switch transistor Q is turned on can be detected.

When the voltage value of the first terminal at a time when the switch transistor Q is turned off is detected, if the voltage value of the first terminal is higher than a preset voltage when the switch transistor Q is turned off, the switch transistor Q is controlled to be turned on, so as to prevent a high voltage between the first terminal and the second terminal from damaging the switch transistor Q.

In this embodiment, a maximum voltage after the switch transistor Q is turned off can be estimated according to the current value of the second terminal of the switch transistor Q. When detecting the current value of the second terminal at a time when the switch transistor Q is turned on, if the current value of the second terminal is larger than a preset value when the switch transistor Q is turned on, the switch transistor Q is controlled to be turned off, so as to prevent that the voltage rises too high to damage the switch transistor Q after the switch transistor Q is turned off.

In embodiments of the present disclosure, by providing the protection module 240, the work state of the switch transistor Q is controlled according to the voltage value of the first terminal when the switch transistor Q is turned off, or the work state of the switch transistor Q is controlled according to current value of the second terminal when the switch transistor Q is turned on, thus it is effectively prevented that the voltage between the first terminal and the second terminal is so high to damage the switch transistor Q when the switch transistor Q is turned off. Therefore, the electromagnetic heating circuit provided in the present disclosure improves stability of circuit operation.

Based on above embodiments, different detection modes are described in detail in the following.

In a second embodiment, when the protection module is configured to control a work state of the switch transistor Q according to a voltage value of the first terminal when the switch transistor Q is turned off, the protection module includes a voltage sampling circuit and a comparator. The voltage sampling circuit includes a first resistor and a second resistor. One terminal of the first resistor is connected to the first terminal, and the other terminal of the first resistor is connected to the ground terminal via the second resistor. A non-inverting input terminal of the comparator is connected to a common terminal of the first resistor and the second resistor, an inverting input terminal of the comparator is connected to a preset reference voltage terminal, and an output terminal of the comparator is connected to the control terminal.

In this embodiment, when the switch transistor Q is turned off, and when a voltage across two terminals of the second resistor is lower than a preset reference voltage of the preset reference voltage terminal (i.e., a voltage between the first terminal and the second terminal is lower than a preset voltage), the switch transistor Q may keep a turn-off state according to the pulse width modulation signal output by the signal output terminal. When the voltage across two terminals of the second resistor is higher than the preset reference voltage of the preset reference voltage terminal (i.e., the voltage between the first terminal and the second terminal is higher than the preset voltage), the comparator may output a high level, thus turning on the switch transistor Q, and releasing the energy stored in the coil L and the resonance capacitor C.

In a third embodiment, when the protection module is configured to control a work state of the switch transistor Q according to a voltage value of the first terminal when the switch transistor Q is turned off, the protection module 240 includes a voltage sampling circuit and a comparator. The voltage sampling circuit includes a first resistor and a second resistor. One terminal of the first resistor is connected to the first terminal, and the other terminal of the first resistor is connected to the ground terminal via the second resistor. A non-inverting input terminal of the comparator is connected to a common terminal of the first resistor and the second resistor, an inverting input terminal of the comparator is connected to a preset reference voltage terminal, and an output terminal of the comparator is connected to the drive module 30.

When the voltage value of the first terminal is higher than the preset reference voltage, the comparator outputs a control signal to the drive module 30. The drive module 30 controls the signal output terminal to output a preset level signal according to the control signal, so as to turn on the switch transistor Q.

In this embodiment, when the switch transistor Q is turned off, and when a voltage across two terminals of the second resistor is lower than a preset reference voltage of the preset reference voltage terminal (i.e., a voltage between the first terminal and the second terminal is lower than a preset voltage), the switch transistor Q may keep a turn-off state according to the pulse width modulation signal output by the signal output terminal. When the voltage across two terminals of the second resistor is higher than the preset reference voltage of the preset reference voltage terminal (i.e., the voltage between the first terminal and the second terminal is higher than the preset voltage), the comparator may output a high level signal to the drive module 30, such that the drive module 30 controls the signal output terminal of the drive circuit 30 to output a high level signal, thus turning on the switch transistor Q, and releasing the energy stored in the coil L and the resonance capacitor C.

In a fourth embodiment, when the protection module is configured to control a work state of the switch transistor Q according to a voltage value of the first terminal when the switch transistor Q is turned off, the protection module 240 includes a voltage sampling circuit and a comparator. The voltage sampling circuit includes a first resistor and a second resistor. One terminal of the first resistor is connected to the first terminal, and the other terminal of the first resistor is connected to the ground terminal via the second resistor. A non-inverting input terminal of the comparator is connected to a common terminal of the first resistor and the second resistor, an inverting input terminal of the comparator is connected to a preset reference voltage terminal, and an output terminal of the comparator is connected to the control chip 10.

When the voltage value of the first terminal is higher than the preset reference voltage, the comparator outputs a control signal to the control chip 10, such that the control chip 10 adjusts a duty ratio of the pulse width modulation signal output to the drive module 30.

In this embodiment, the duty ratio of the pulse width modulation signal output to the drive module 30 is changed by the control chip 10, such that the voltage value between the first terminal and the second terminal is limited during a period in which the switch transistor Q is turned off, and it is prevented that the switch transistor Q is damaged due to a high voltage between the first terminal and the second terminal during a period in which the switch transistor Q is turned off, thus extending using life of the switch transistor Q.

In a fifth embodiment, when the protection module is configured to control the work state of the switch transistor Q according to a detected current value of the second terminal when the switch transistor Q is turned on, the electromagnetic heating circuit further includes a current-limiting resistor R11 connected in series between the second terminal and the ground terminal. A voltage detection terminal of the protection module is connected to the second terminal so as to detect the current value of the second terminal.

In this embodiment, the protection module can obtain a current flowing through the current-limiting resistor R11 (a current value of the second terminal of the switch transistor Q) according to a voltage value detected by the voltage detection terminal. Then, a maximum voltage between the first terminal and the second terminal after the switch transistor Q is turned off is estimated according to the current value of the second terminal. When the current flowing through the current-limiting resistor R11 makes the maximum voltage higher than the preset voltage, the switch transistor Q is controlled to be turned off, so as to ensure that the maximum voltage between the first terminal and the second terminal is lower than the preset voltage after the switch transistor Q is turned off, thus preventing from damaging the switch transistor Q. At this time, the current flowing through the current-limiting resistor R11 is a maximum current allowed to be flowed through when the switch transistor Q is turned on, which can be called as a preset value hereinafter. It should be noted that, the current-limiting resistor R11 can be a built-in resistor of the protection module, and can be a peripheral resistor.

It can be understood that, a state of level output by the signal output terminal of the drive module 30 can be controlled by the drive module 30, or can be controlled by controlling the pulse width modulation signal output to the drive module 30 from the control chip 10, specific implementation mode of which can be set according to actual requirement, and no further limitations are made here.

Based on the fifth embodiment, in an embodiment, the protection module is connected to the drive module 30. The protection module outputs a control signal to the drive module 30 when the current value of the second terminal is detected to be higher than a preset value, such that the drive module 30 controls the signal output terminal to output a preset level signal, so as to turn off the switch transistor Q.

In another embodiment, the protection module is connected to the control chip 10. The protection module outputs a control signal to the control chip 10 when the current value of the second terminal is detected to be higher than a preset value, such that the control chip 10 adjusts a duty ratio of the pulse width modulation signal output to the drive module 30.

It can be understood that, in the circuit design, any one of the above two implementation modes can be used, and the control signal can also be output to both the drive module 30 and the control chip 10 by the protection module. That is the signal output terminal of the protection module can be connected to both the drive module 30 and the control chip 10.

Further, based on any one of above embodiments, the electromagnetic heating circuit further includes a temperature sensor 150 configured to detect a temperature of the switch transistor Q. The temperature sensor 150 is connected to the protection module. The protection module is configured to output a control signal to the drive module 30 or to the control chip 10 according to the temperature detected by the temperature sensor 150, such that the drive module 30 or the control chip 10 adjusts a duty ratio of the pulse width modulation signal output by the signal output terminal or turns off the switch transistor Q according to the control signal.

In embodiments of the present disclosure, the protection module detects the temperature of the switch transistor Q via the temperature sensor 150, sends the temperature of the switch transistor Q to the drive module 30 or to the control chip 10, and the duty ratio of the pulse width modulation signal is adjusted by the drive module 30 or to the control chip 10 according to the temperature, thus realizing operations such as reducing power, improving power, turning off the switch transistor Q, and the like.

Figure 5:
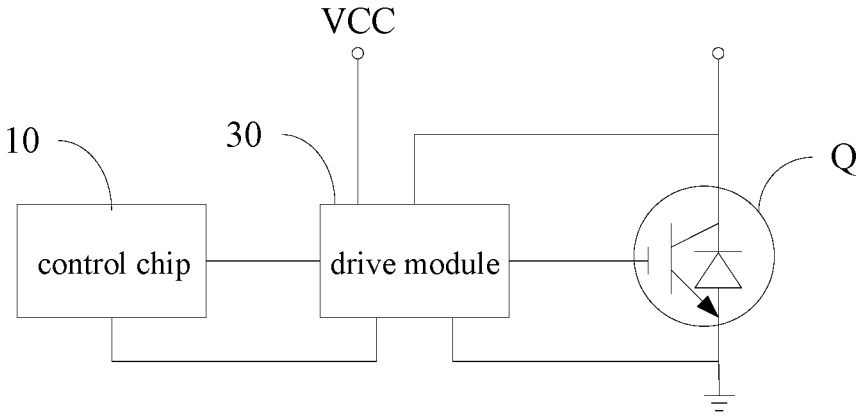
FIG. 5 is a schematic diagram showing a structure of an electromagnetic heating circuit according to an embodiment of the present disclosure.

The present disclosure provides an electromagnetic heating circuit, as illustrated in FIG. 5. In an embodiment, the electromagnetic heating circuit includes a control chip 10, a drive module 30, and a switch transistor Q.

The switch transistor Q includes a first terminal, a second terminal, and a control terminal configured to control a connection state between the first terminal and the second terminal, the control terminal is connected to a signal output terminal of the drive module 30.

The control chip 10 is configured to output a pulse width modulation signal to the drive module 30. The pulse width modulation signal is output to the switch transistor Q via the signal output terminal of the drive module 30, so as to drive the switch transistor Q.

The drive module 30 is configured to detect an output voltage value of the signal output terminal, and to adjust a state of the pulse width modulation signal output by the signal output terminal according to whether the output voltage value of the signal output terminal is within a preset interval range.

The electromagnetic heating circuit provided in this embodiment is configured to realize drive controlling of the switch transistor Q. Structure of the switch transistor Q can be set according to actual requirement. In an embodiment, the switch transistor Q is an IGBT. A collector of the IGBT is configured as the first terminal, an emitter of the IGBT is configured as the second terminal, and a gate of the IGBT is configured as the control terminal.

The preset interval range can be set according to actual requirement, which is not limited herein, as long as the switch transistor can be driven and it can be prevented that the switch transistor is burned out.

The drive module 30 adjusts state of the pulse width modulation signal output by the signal output terminal according to whether the output voltage value of the signal output terminal is within a preset interval range as follows.

When the output voltage value of the signal output terminal is not within a preset interval range, the drive module controls the signal output terminal to stop outputting the pulse width modulation signal.

Alternatively, when the output voltage value of the signal output terminal is not within a preset interval range, the drive module outputs a control signal to the control chip, such that the control chip stops outputting the pulse width modulation signal.

It should be noted that, the drive module 30 can use a built-in voltage sampling circuit to detect a voltage value of a signal input terminal, or use a comparator to determine the voltage value of the first terminal, specific circuit arrangement can be set according to actual requirement, which is not limited herein. It can be understood that, when the output voltage value of the signal output terminal is not within the preset interval range, the output voltage value of the signal output terminal of the drive module 30 can be adjusted by the control chip 10 or the drive module 30, so as to make the output voltage value of the signal output terminal maintain within the preset interval range. The output voltage of the signal output terminal is a drive voltage of the gate of the IGBT. For example, when the drive voltage of the gate of the IGBT is larger than an upper limit value of the preset interval range, the drive module 30 can stop outputting the pulse width modulation signal to output to the gate of the IGBT, i.e., pulling down the voltage of the gate of the IGBT. Thus, it is prevented that the drive voltage of the gate of the IGBT is so high to damage the IGBT.

In embodiments of the present disclosure, by providing the drive module 30 connected to the control chip 10 and the switch transistor Q, the drive module 30 controls the state of the pulse width modulation signal output by the signal output terminal according to the voltage of the signal output terminal, thus it is effectively prevented that the drive voltage of the switch transistor Q is so high to burn out the switch transistor Q, and that the drive voltage of the switch transistor is so low that the switch transistor cannot be turned on or in a magnifying state. Therefore, the present disclosure improves stability of the switch transistor Q.

Further, based on above embodiments, in one embodiment, the drive module 30 is further configured to perform a comparison on the received pulse width modulation signal and a preset reference square signal, and to adjust the state of the pulse width modulation signal output by the signal output terminal according to a result of the comparison.

In this embodiment, the reference square signal can be generated by the control chip 30, or be generated by a square signal generating circuit. A pulse width of the reference square signal is a maximum pulse width allowed to be output.

When a pulse width of the pulse width modulation signal received by the drive module 30 is larger than a pulse width of the reference square signal, the drive module 30 adjusts a pulse width in a corresponding cycle of the pulse width modulation signal output by the signal output terminal to the pulse width of the reference square signal, and/or controls the signal output terminal to stop outputting the pulse width modulation signal.

Alternatively, when the pulse width of the pulse width modulation signal received by the drive module 30 is larger than the pulse width of the reference square signal, the drive module 30 outputs a control signal to the control chip 10, such that the control chip 10 adjusts the state of the pulse width modulation signal output to the drive module 30.

In this embodiment, by limiting the duty ratio of the pulse width modulation signal, phenomenon such as over-current, over-voltage, overheating, and the like of the IGBT due to long conducting time of the IGBT is prevented, thus improving security for using the IGBT.

Further, based on above embodiments, in an embodiment, the drive module 30 is further configured to detect a voltage between the collector and the emitter of the insulated gate bipolar transistor, to determine a work state of the insulated gate bipolar transistor according to a voltage between the collector and the emitter of the insulated gate bipolar transistor at a time when the insulated gate bipolar transistor is turned on, and to adjust a time period for the output voltage value of the signal output terminal to rise to a second preset value according to the work state.

It should be noted that, a voltage detection terminal of the drive module 30 is connected to the collector of the IGBT, and a ground terminal of the drive module 30 is connected to the emitter of the IGBT, thus the voltage between the collector and the emitter of IGBT can be detected.

The work state of the insulated gate bipolar transistor includes a start state, a hard turn-on state, and a normal state.

Adjusting a time period for the output voltage value of the signal output terminal to rise to a second preset value according to the work state includes follows.

When the work state is the start state, the time period for the output voltage value of the signal output terminal to rise to the second preset value is set to be a first threshold.

When the work state is the hard turn-on state, the time period for the output voltage value of the signal output terminal to rise to the second preset value is set to be a second threshold.

When the work state is the normal state, the time period for the output voltage value of the signal output terminal to rise to the second preset value is set to be a third threshold.

In this embodiment, a current peak value of the IGBT may be very large in following two situations. One is a hard-on/off caused by leading conduction (i.e. the IGBT is turned on when Vce of the IGBT has not reached 0) of the IGBT, and the other one is that a resonant capacitance rises sharply from 0 to a DC bus voltage (to be 311V under a condition of 220V) in a first cycle of turning on.

Figure 6:
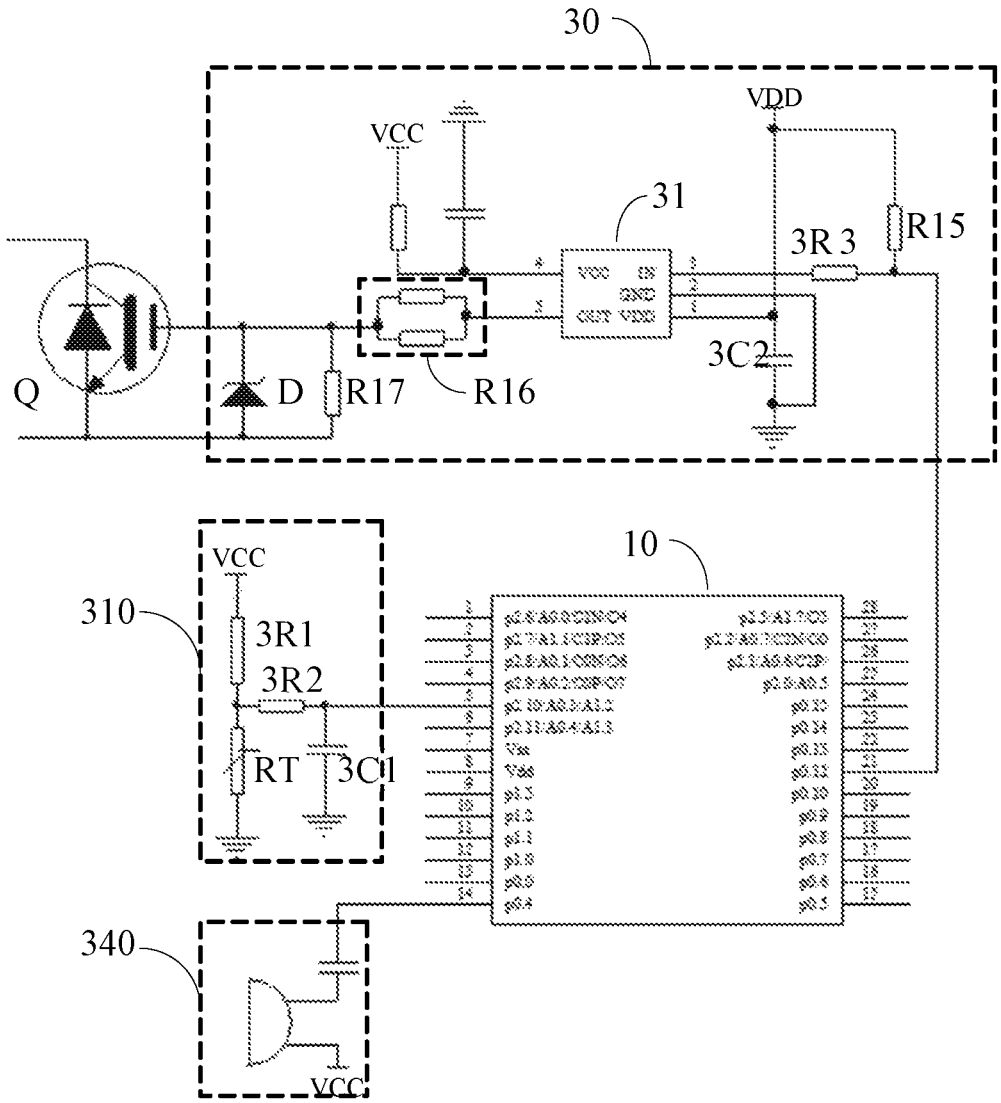
FIG. 6 is a schematic diagram showing a structure of an electromagnetic heating control circuit according to an embodiment of the present disclosure.

The present disclosure provides an electromagnetic heating control circuit, as shown in FIG. 6. In one embodiment, the electromagnetic heating control circuit includes a switch transistor Q, a temperature detection module 310 configured to detect a temperature of the switch transistor Q, a control chip 10 configured to output a pulse width modulation signal, and a drive circuit 30 configured to magnify the pulse width modulation signal and to output a magnified pulse width modulation signal to the switch transistor Q.

The switch transistor Q includes a first terminal, a second terminal, and a control terminal configured to control a connection state between the first terminal and the second terminal. The control terminal is connected to a signal output terminal of the drive circuit 30.

An output terminal of the temperature detection module 310 is connected to the control chip 10.

The control chip 10 is configured to obtain a temperature currently detected by the temperature detection module 310 at first predetermined time intervals, to perform error correction on the currently detected temperature according to two temperatures detected twice in succession and a temperature compensation factor to calculate an actual temperature, and to control a work state of the switch transistor Q according to the actual temperature.

The drive circuit provided in this embodiment is configured to realize drive controlling of the switch transistor Q. Structure of the switch transistor Q can be set according to actual requirement. In an embodiment, preferably, the switch transistor Q is an IGBT. A collector of the IGBT is configured as the first terminal, an emitter of the IGBT is configured as the second terminal, and a gate of the IGBT is configured as the control terminal.

It can be understood that, above electric heater is an electromagnetic heating device, for example, an induction cooker, an electric cooker and the like. At the beginning of starting up and heating, the control chip 10 reads the temperature detected by the temperature detection module 310 at fixed time intervals, and denotes the read-out temperature as a temperature $X_n$ at current moment, and denotes temperatures read at a previous time as $X_{n-1}$, $X_{n-2}$, $X_{n-3}$, and so on. Then the actual temperature $Y_n$ at current moment of the switch transistor is calculated according to $X_n$, $X_{n-1}$, and the temperature compensation factor.

The preset temperature compensation factor can be set according to actual requirement. In an embodiment, preferably, the temperature compensation factor can be obtained by following modes.

The control chip 10 obtains a temperature currently detected by the temperature detection module 310 at second predetermined time intervals. The control chip 10 calculates the temperature compensation factor A corresponding to a difference between a temperature $X_n$ detected for $n^{th}$ time and a temperature $X_{n-1}$ detected for $(n-1)^{th}$ time according to the temperature $X_n$ and the temperature $X_{n-1}$. The temperature compensation factor A satisfies $$A = \frac{X_n(X_n - X_{n-1})^2}{KM},$$

where, K is a constant, and M is an initial temperature for temperature compensation.

It should be noted that, the initial temperature is a temperature configured to control a beginning of the temperature compensation, that is, the temperature compensation is performed when a detected temperature is larger than the initial temperature.

In an embodiment, values of the constant K and the initial temperature M can be set according to actual requirement. For example, preferably, the constant K is 0.2, the initial temperature M is 50.

It should be noted that, the temperature compensation factor A is firstly obtained through above modes before the electromagnetic heating control circuit performs temperature protection. Different temperature changing states correspond to different temperature compensation factors respectively. When the temperature protection is performed, the control chip 10 obtains a temperature detected by the temperature detection module 310 at first predetermined time intervals, obtains the temperature compensation factor A corresponding to a difference between a temperature $X_m$ detected for current time and a temperature $X_{m-1}$ detected for last time according to the temperature $X_m$ and the temperature $X_{m-1}$, calculates the actual temperature $Y_m$, according to the temperature $X_m$ detected for current time, the temperature $X_{m-1}$ detected for last time, and the temperature compensation factor A. $Y_m$ satisfies $Y_m=X_{m-1}+A(X_m-X_{m-1})$. When $Y_n$ is larger than a preset value, the control chip 10 can output a control signal to the drive circuit 30, to control the switch transistor Q to turn off, thus preventing the switch transistor Q from being damaged due to high temperature. Since the temperature compensation calculation is performed, it is prevented that the switch transistor Q is damaged due to low accuracy for temperature detection. Therefore, embodiments of the present disclosure can improve precision of temperature detection of the switch transistor and the stability of circuit operation.

By providing the temperature detection module 310 configured to detect the temperature of the switch transistor Q, and controlling the work state of the switch transistor Q according to the detected temperatures and the preset temperature compensation factor, the electromagnetic heating control circuit provided by embodiments of the present disclosure can prevent the switch transistor Q from being burnt out due to high temperature. Thus the present disclosure improves the stability of circuit operation.

It should be noted that, the temperature detection module 310 includes a temperature sensor RT, a thirty-first resistor 3R1, a thirty-second resistor 3R2 and a thirty-first capacitor 3C1. One terminal of the thirty-first resistor 3R1 is connected to a first preset power source VCC, and the other terminal of the thirty-first resistor 3R1 is connected to a ground terminal via the temperature sensor RT. One terminal of the thirty-second resistor 3R2 is connected to a common terminal of the thirty-first resistor 3R1 and the temperature sensor RT, and the other terminal of the thirty-second resistor 3R2 is connected to a ground terminal via the thirty-first capacitor 3C1. A common terminal of the thirty-second resistor 3R2 and the thirty-first capacitor 3C1 is connected to a temperature collecting terminal of the control chip 10.

In an embodiment, structure of the temperature sensor RT can be set according to actual requirement. For example, the temperature sensor RT is a thermistor.

The drive circuit 30 includes a drive integrated chip 31, a thirty-third resistor 3R3, a fifteenth resistor R15, a sixteenth resistor R16, a seventeenth resistor R17 and a thirty-second capacitor 3C2. A pulse width modulation signal input terminal of the drive integrated chip 31 is connected to the control chip 10 via the thirty-third resistor 3R3, a drive voltage input terminal of the drive integrated chip 31 is connected to a second preset power source VDD, and a pulse width modulation signal output terminal of the drive integrated chip 31 is connected to the control terminal of the switch transistor Q via the sixteenth resistor R16. One terminal of the fifteenth resistor R15 is connected to the second preset power source VDD, and the other terminal of the fifteenth resistor R15 is connected to a common terminal of the thirty-third resistor 3R3 and the control chip 10. One terminal of the seventeenth resistor R17 is connected to the control terminal of the switch transistor Q, and the other terminal of the seventeenth resistor R17 is connected to the second terminal of the switch transistor Q. One terminal of the thirty-second capacitor 3C2 is connected to the drive voltage input terminal, and the other terminal of the thirty-second capacitor 3C2 is connected to a ground terminal.

It should be noted that, values of the first preset power source VCC and the second preset power source VDD can be set according to actual requirement. In an embodiment, preferably, the first preset power source VCC is a power source of +5V, and the second preset power source VDD is a power source of +15V. In an embodiment, after a pulse signal input by the pulse width modulation signal input terminal of the drive integrated chip 31 is driven and magnified via the second preset power source VDD, driven and magnified pulse signal is output from the pulse width modulation signal output terminal, and is divided by the sixteenth resistor R16 and the seventeenth resistor R17. The switch transistor Q performs switching between the turn-on state and the turn-off state according to a voltage across two terminals of the seventeenth resistor R17.

Further, based on above embodiments, in an embodiment, in order to prevent the switch transistor Q from being damaged due to a high drive voltage of the switch transistor Q, preferably, the drive circuit 30 further includes a Zener diode D. An anode of the Zener diode D is connected to the second terminal of the switch transistor Q, and a cathode of the Zener diode D is connected to the control terminal of the switch transistor Q.

Further, based on above embodiments, in an embodiment, the electric heating drive protection circuit further includes a buzzer circuit 340. The buzzer circuit 340 is connected to the control chip 10.

In this embodiment, when the control chip 10 detects that the temperature currently detected by the temperature detection module 310 is larger than a preset value, that is, a temperature of the switch transistor Q is too high, a control signal can be output to the buzzer circuit 340 when a control signal is output to the drive circuit 30 to turn off the switch transistor Q, so as to control the buzzer circuit 340 to buzz, thus promoting a user that there is potential danger in an electric heater. Therefore, the present disclosure can improve security for using the electric heater.

Figure 7:
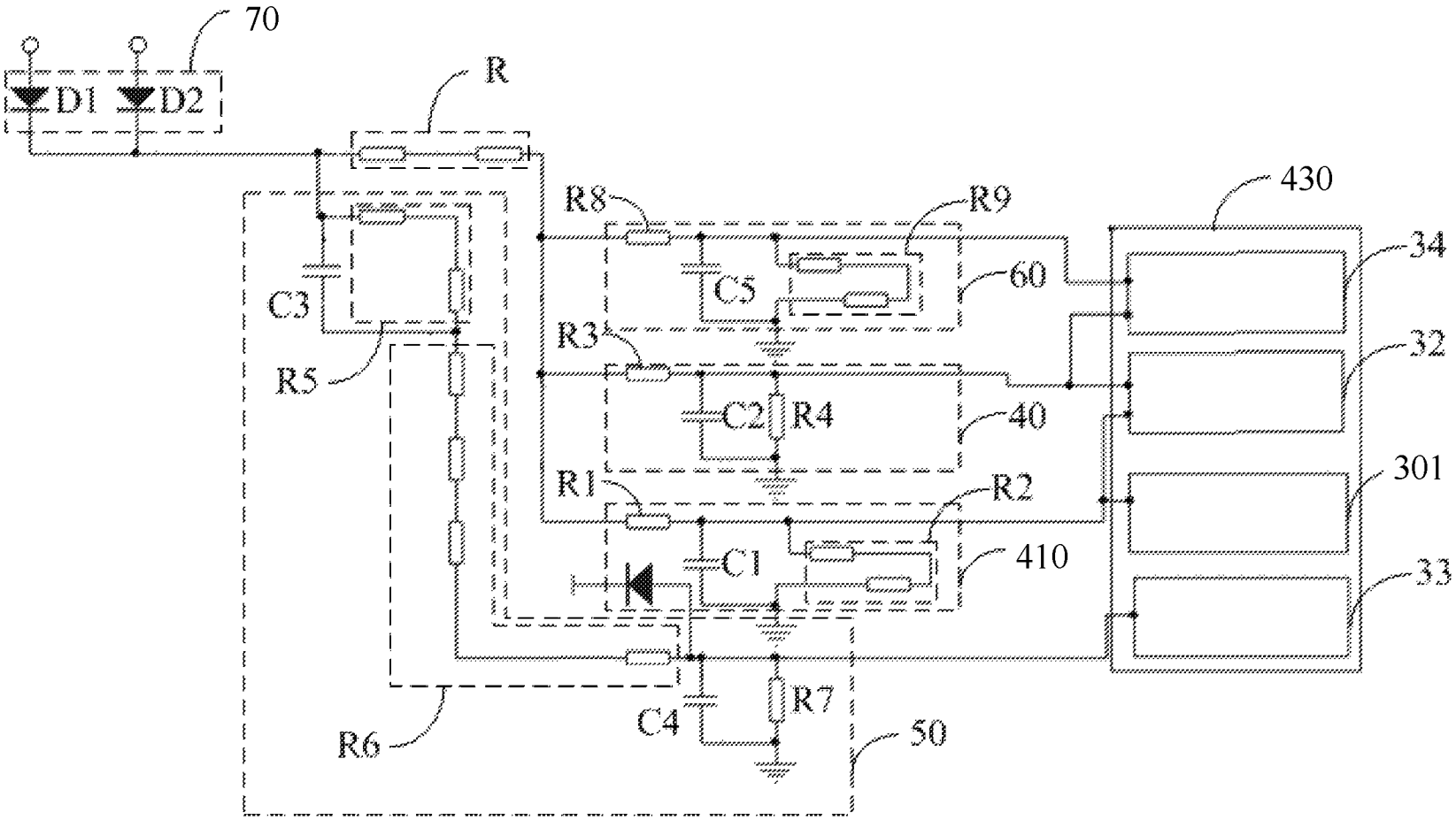
FIG. 7 is a schematic diagram showing a structure of a surge protection circuit according to an embodiment of the present disclosure.

The present disclosure provides a surge protection circuit, as illustrated in FIG. 7. In an embodiment, the surge protection circuit includes a first voltage division circuit 410 consisted of resistors and capacitors, a rectifying circuit 70 configured to perform rectification on mains supply, and a control circuit 430 configured to perform surge protection. The control circuit 430 includes a first comparator 301.

An input terminal of the first voltage division circuit 410 is connected to an output terminal of the rectifying circuit 70, and an output terminal of the first voltage division circuit 410 is connected to a first input terminal of the first comparator 301. A second input terminal of the first comparator 301 is connected to a preset first reference power source. When a voltage of the mains supply is lower than a first preset value, and when there is positive surge, a voltage of the output terminal of the first voltage division circuit 410 is higher than a voltage of the first reference power source. When the voltage of the mains supply is lower than a first preset value, and when there is no positive surge, the voltage of the output terminal of the first voltage division circuit 410 is lower than the voltage of the first reference power source. The control circuit 430 performs surge protection control according a state of an output level of an output terminal of the first comparator 301.

In an embodiment, the first input terminal of the first comparator 301 may be a non-inverting input terminal, or may be an inverting input terminal, which can be set according to actual requirement, and it is not limited herein. The voltage of preset first reference power source can be set according to actual requirement. In an embodiment, preferably, a voltage of the first reference power source is +5V.

In an operating process, when the voltage of the mains supply is lower than the first preset value, i.e., the voltage of the mains supply is close to a zero-crossing point, if there is no positive surge voltage generated, the voltage of the output terminal of the first voltage division circuit 410 is lower than the voltage of the first reference power source, and the first comparator 301 outputs a first level signal. If there is a peak surge voltage, the output terminal of the first comparator 301 outputs a reverse voltage to generate a second level signal when the peak surge voltage arrives, and the control circuit 430 performs surge protection operation according the second level signal.

In embodiments of the present disclosure, after the mains supply is rectified by the provided rectifying circuit 70, voltage division is performed by the first voltage division circuit 410, and a comparison is performed on divided voltage and the first reference voltage, and it is determined whether there is a positive surge voltage in a period when the mains supply is close to the zero-crossing point according a result of the comparison, if there is a positive surge voltage, the control circuit 10 performs the surge protection. The present disclosure realizes surge detection in the period when the mains supply is close to the zero-crossing point, so as to prevent the electrical equipment from being damaged due to a surge phenomenon when the mains supply is at the zero-crossing point, thus improving security for power supply.

The first voltage division circuit 410 includes a first resistor R1, a second resistor R2, and a first capacitor C1. One terminal of the first resistor R1 is connected to the output terminal of the rectifying circuit 70, and the other terminal of the first resistor R1 is connected to a ground terminal via the second resistor R2. The first capacitor C1 is connected in parallel to two terminals of the second resistor R2. The first input terminal of the first comparator 301 is connected to a common terminal of the first resistor R1 and the second resistor R2.

It can be understood that, each of the first resistor R1 and the second resistor R2 can be one resistor, or be formed by connecting a plurality of resistors in series, as long as they satisfy corresponding resistance requirement so as to realize corresponding voltage division ratio.

Further, based on above embodiments, in an embodiment, the surge protection circuit further includes a second voltage division circuit 40 and a third voltage division circuit 50 consisted of resistors and capacitors, and. The control circuit 430 further includes a second comparator 32 and a third comparator 33.

An input terminal of the second voltage division circuit 40 is connected to the output terminal of the rectifying circuit 70. An output terminal of the second voltage division circuit 40 is connected to a first input terminal of the second comparator 32. A second input terminal of the second comparator 32 is connected to the output terminal of the first voltage division circuit 410. When there is no positive surge voltage in the mains supply, the voltage of the output terminal of the first voltage division circuit 410 is higher than a voltage of the output terminal of the second voltage division circuit 40. When there is a positive surge voltage in the mains supply, the voltage of the output terminal of the first voltage division circuit 410 is lower than the voltage of the output terminal of the second voltage division circuit 40.

An input terminal of the third voltage division circuit 50 is connected to the output terminal of the rectifying circuit 70. An output terminal of the third voltage division circuit 50 is connected to a first input terminal of the third comparator 33. A second input terminal of the third comparator 33 is connected to a preset second reference power source, configured to detect a zero-crossing point of the mains supply, and to control an output terminal of the second comparator 32 to output a preset level signal when a voltage of the output terminal of the third voltage division circuit 50 is lower than a second preset value.

In this embodiment, by comparing the voltage of the second voltage division circuit 40 and the voltage of the first voltage division circuit 410, surge detection in the mains supply is realized. Further, a voltage division circuit can be provided to realize negative surge detection.

The surge protection circuit further includes a fourth voltage division circuit 60 consisted of resistors and capacitors. The control circuit 430 further includes a fourth comparator 34.

An input terminal of the fourth voltage division circuit 34 is connected to the output terminal of the rectifying circuit 70. An output terminal of the fourth voltage division circuit 60 is connected to a first input terminal of the fourth comparator 34. A second input terminal of the fourth comparator 34 is connected to the output terminal of the second voltage division circuit 60. When there is no negative surge voltage in the mains supply, a voltage of the output terminal of the fourth voltage division circuit 60 is lower than the voltage of the output terminal of the second voltage division circuit 40. When there is a negative surge voltage in the mains supply, the voltage of the output terminal of the fourth voltage division circuit 60 is higher than the voltage of the output terminal of the second voltage division circuit 40.

The third comparator 33 is further configured to control an output terminal of the fourth comparator 34 to output a preset level signal when the voltage of the output terminal of the third voltage division circuit 50 is lower than the second preset value.

In an embodiment, the third voltage division circuit 50 used to realize zero-cross detection. When the voltage of the output terminal of the third voltage division circuit 50 is higher than the second preset value, the output terminal of the third comparator 32 outputs a level signal. When the voltage of the output terminal of the third voltage division circuit 50 is lower than the second preset value, the output terminal of the third comparator 32 outputs a reverse level signal. At this time, the control circuit 430 shields the preset level signal output by the second comparator 32 and the fourth comparator 34 according to the reverse level signal, so as to prevent output voltages of the first voltage division circuit 410, the second voltage division circuit 40 and the fourth voltage division circuit 60 from being close when the mains supply is close to the zero-crossing point, and prevent a false output of the second comparator 32 and the fourth comparator 34, thus improving stability of power supply.

The second voltage division circuit 40 includes a third resistor R3, a fourth resistor R4, and a second capacitor C1. One terminal of the third resistor R3 is connected to the output terminal of the rectifying circuit 20, and the other terminal of the third resistor R3 is connected to a ground terminal via the fourth resistor R4. The second capacitor C2 is connected in parallel to two terminals of the fourth resistor R4. A first input terminal of the second comparator 32 is connected to a common terminal of the third resistor R3 and the fourth resistor R4.

The third voltage division circuit 50 includes a fifth resistor R5, a sixth resistor R6, a seventh resistor R7, a third capacitor C3, and a fourth capacitor C4. One terminal of the fifth resistor R5 is connected to the output terminal of the rectifying circuit 70, and the other terminal of the fifth resistor R5 is connected to a ground terminal via a serial connection of the sixth resistor R6 and the seventh resistor R7. The third capacitor C3 is connected in parallel to two terminals of the fifth resistor R5. The fourth capacitor C4 is connected in parallel to two terminals of the seventh resistor R7. The first input terminal of the third comparator 33 is connected to a common terminal of the sixth resistor R6 and the seventh resistor R7.

The fourth voltage division circuit 60 includes an eighth resistor R8, a ninth resistor R9, and a fifth capacitor C5. One terminal of the eighth resistor R8 is connected to the output terminal of the rectifying circuit 70, and the other terminal of the eighth resistor R8 is connected to a ground terminal via the ninth resistor R9. The fifth capacitor C5 is connected in parallel to two terminals of the ninth resistor R9. The first input terminal of the fourth comparator 34 is connected to a common terminal of the eighth resistor R8 and the ninth resistor R9.

It should be noted that, each of the third resistor R3, the fourth resistor R4, the fifth resistor R5, the sixth resistor R6, and the seventh resistor R7 can be one resistor, or be formed by a plurality of resistors connected in series. Capacitances of the first capacitor C1, the second capacitor C2, and the fifth capacitor C5 can be set according to actual requirement. In an embodiment, preferably, a capacitance of the first capacitor C1 is equal to a capacitance of the fifth capacitor C5. The capacitance of the first capacitor C1 is larger than a capacitance of the second capacitor C2.

It can be understood that, in order to reduce voltage division requirement of the first voltage division circuit 410, the second voltage division circuit 40, and the fourth voltage division circuit 60, a voltage division resistor R for common voltage division can be provided at a common input terminal of the first voltage division circuit 410, the second voltage division circuit 40, and the fourth voltage division circuit 60, and the output terminal of the rectifying circuit 70, and after a voltage division by the voltage division resistor R, another voltage division is performed by the first voltage division circuit 410, the second voltage division circuit 40, and the fourth voltage division circuit 60 respectively.

It should be noted that, structure of the rectifying circuit 70 can be set according to actual requirement, including a first diode D1 and a second diode D2. An anode of the first diode D1 is connected to a first alternating current input terminal of the mains supply. The second diode D2 is connected to a second alternating current input terminal of the mains supply. A cathode of the first diode D1 is connected to a cathode of the second diode D2.

In an embodiment, the first alternating current input terminal can be a terminal of L line, and the second alternating current input terminal is a terminal of N line. The first alternating current input terminal can also be a terminal of N line, and the second alternating current input terminal is a terminal of L line. In this embodiment, the first diode D1 and the second diode D2 are used to perform full-wave rectification on the mains supply, thus realizing positive surge detection and negative surge detection.

The present disclosure further provides a household appliance. The household appliance includes an electromagnetic heating control circuit. Structure of the electromagnetic heating control circuit can refer to above embodiments, which is not described in detail herein. Reasonably, since the household appliance according to the present disclosure uses technical solutions of the above electromagnetic heating control circuit, the household appliance has beneficial effects of the above electromagnetic heating control circuits.

Above are preferable embodiments of the present disclosure, and are not intended to limit the scope of the present disclosure. Any transformations of equivalent constructions or equivalent processes using the specification and the accompanying drawings of the present disclosure, either directly or indirectly, in other related technical fields, is likewise included within the scope of the protection of the present disclosure.

What is claimed is:

1. An electromagnetic heating control circuit, comprising: a control chip, a rectifying and filtering circuit, a resonance capacitor, a switch transistor, a drive circuit, and a synchronous voltage detection circuit, wherein:

the switch transistor comprises a first terminal, a second terminal, and a control terminal configured to control a connection state between the first terminal and the second terminal, the first terminal is connected to a positive output terminal of the rectifying and filtering circuit via the resonance capacitor, the second terminal is connected to a negative output terminal of the rectifying and filtering circuit via a current-limiting resistor; and the control chip comprises a non-inverting voltage input terminal, an inverting voltage input terminal, a voltage detection terminal, and a signal output terminal, the non-inverting voltage input terminal and the inverting voltage input terminal detect voltages at two terminals of the resonance capacitor via the synchronous voltage detection circuit, the signal output terminal is connected to the control terminal via the drive circuit, the voltage detection terminal is connected to the positive output terminal of the rectifying and filtering circuit via the synchronous voltage detection circuit, the control chip is configured to control a work state of the switch transistor according to a voltage detected by the voltage detection terminal, and to control, according to voltages of the non-inverting voltage input terminal and the inverting voltage input terminal, the switch transistor to turn on when a voltage at a connection node between the resonance capacitor and the switch transistor is zero.

2. The electromagnetic heating control circuit according to claim 1, wherein the synchronous voltage detection circuit comprises:

a first voltage sampling circuit, wherein one terminal of the first voltage sampling circuit is connected to the positive output terminal of the rectifying and filtering circuit, and the other terminal of the first voltage sampling circuit is connected to the non-inverting voltage input terminal and the voltage detection terminal respectively; and a second voltage sampling circuit, wherein one terminal of the second voltage sampling circuit is connected to the first terminal of the switch transistor, and the other terminal of the second voltage sampling circuit is connected to the inverting voltage input terminal.

3. The electromagnetic heating control circuit according to claim 1, wherein the drive circuit comprises a drive chip, a fifteenth resistor, a sixteenth resistor, and a seventeenth resistor, wherein:

a drive input terminal of the drive chip is connected to the signal output terminal of the control chip via the fifteenth resistor, the drive input terminal is connected to a preset power source, a drive output terminal of the drive chip is connected to the second terminal of the switch transistor via a serial connection of the sixteenth resistor and the seventeenth resistor, a common terminal of the sixteenth resistor and the seventeenth resistor is connected to the control terminal of the switch transistor.

4. The electromagnetic heating control circuit according to claim 1, wherein the rectifying and filtering circuit comprises a bridge rectifier, an inductor and a capacitor, wherein:

a positive output terminal of the bridge rectifier is connected to the resonance capacitor via the inductor, and a negative output terminal of the bridge rectifier is connected to the second terminal of the switch transistor via the current-limiting resistor; and one terminal of the capacitor is connected to a common terminal of the inductor and resonance capacitor, and the other terminal of the capacitor is connected to the negative output terminal of the bridge rectifier.

5. The electromagnetic heating control circuit according to claim 1, wherein the switch transistor is an insulated gate bipolar transistor, a collector of the insulated gate bipolar transistor is configured as the first terminal, an emitter of the insulated gate bipolar transistor is configured as the second terminal, and a gate of the insulated gate bipolar transistor is configured as the control terminal.

6. The electromagnetic heating control circuit according to claim 1, wherein:

the drive circuit is connected to the control chip, and the drive circuit is configured to magnify a pulse width modulation signal received from the control chip and to output a magnified pulse width modulation signal to the switch transistor via a signal output terminal of the drive circuit, so as to drive the switch transistor, the drive circuit is further configured to detect an output voltage value of the signal output terminal of the drive circuit, and to adjust a state of the magnified pulse width modulation signal output by the signal output terminal of the drive circuit according to whether the output voltage value is within a preset interval range; and the electromagnetic heating control circuit further comprises a protection circuit, the protection circuit is configured to control the work state of the switch transistor according to a voltage value of the first terminal when the switch transistor is turned off, or the protection circuit is configured to control the work state of the switch transistor according to a detected current value of the second terminal when the switch transistor is turned on.

7. The electromagnetic heating control circuit according to claim 1, wherein the control chip is configured to output the pulse width modulation signal to the drive circuit, the pulse width modulation signal is output to the switch transistor via a signal output terminal of the drive circuit, so as to drive the switch transistor; and the electromagnetic heating control circuit further comprises a protection module, the protection module is configured to control the work state of the switch transistor according to a voltage value of the first terminal when the switch transistor is turned off, or the protection module is configured to control the work state of the switch transistor according to a detected current value of the second terminal when the switch transistor is turned on.

8. The electromagnetic heating control circuit according to claim 1, wherein the control chip is configured to output a pulse width modulation signal to the drive circuit, the pulse width modulation signal is output to the switch transistor via a signal output terminal of the drive circuit, so as to drive the switch transistor; and the drive circuit is configured to detect an output voltage value of the signal output terminal of the drive circuit, and to adjust a state of the pulse width modulation signal output by the signal output terminal of the drive circuit according to whether the output voltage value is within a preset interval range.

9. The electromagnetic heating control circuit according to claim 1, further comprising a temperature detection module configured to detect a temperature of the switch transistor, an output terminal of the temperature detection module connected to the control chip;

wherein the control chip is configured to obtain a temperature currently detected by the temperature detection module at first predetermined time intervals, to perform error correction on the temperature according to two temperatures detected twice in succession and a temperature compensation factor to calculate an actual temperature, and to control the work state of the switch transistor according to the actual temperature.

10. The electromagnetic heating control circuit according to claim 1, further comprising a surge protection circuit, wherein the surge protection circuit comprises a first voltage division circuit comprising a resistor and a capacitor, and a control circuit for surge protection, wherein:

the control circuit comprises a first comparator;

an input terminal of the first voltage division circuit is connected to an output terminal of a rectifying circuit, an output terminal of the first voltage division circuit is connected to a first input terminal of the first comparator;

a second input terminal of the first comparator is connected to a preset first reference power source, and when a voltage of the mains supply is lower than a first preset value, if there is positive surge, a voltage of the output terminal of the first voltage division circuit is higher than a voltage of the preset first reference power source, if there is no positive surge, the voltage of the output terminal of the first voltage division circuit is lower than the voltage of the preset first reference power source; and the control circuit performs surge protection control according a state of an output level of an output terminal of the first comparator.

11. An electromagnetic heating control circuit, comprising: a drive circuit, a protection circuit, and a switch transistor, wherein:

the switch transistor comprises a first terminal, a second terminal, and a control terminal configured to control a connection state between the first terminal and the second terminal, the control terminal is connected to a signal output terminal of the drive circuit, and the second terminal is connected to a ground terminal;

the drive circuit is connected to a control chip, and configured to magnify a pulse width modulation signal received from the control chip and to output a magnified pulse width modulation signal to the switch transistor via the signal output terminal of the drive circuit, so as to drive the switch transistor;

the drive circuit is configured to detect an output voltage value of the signal output terminal, and to adjust a state of the magnified pulse width modulation signal output by the signal output terminal according to whether the output voltage value of the signal output terminal is within a preset interval range; and the protection circuit is configured to control a work state of the switch transistor according to a voltage value of the first terminal when the switch transistor is turned off, or the protection circuit is configured to control the work state of the switch transistor according to a detected current value of the second terminal when the switch transistor is turned on.

12. The electromagnetic heating control circuit according to claim 11, wherein the drive circuit adjusting a state of the magnified pulse width modulation signal output by the signal output terminal according to the output voltage value of the signal output terminal comprises:

when the output voltage value of the signal output terminal is not within the preset interval range, the drive circuit controls the signal output terminal stop outputting the magnified pulse width modulation signal; or when the output voltage value of the signal output terminal is not within the preset interval range, the drive circuit outputs a control signal to the control chip, such that the control chip stops outputting the pulse width modulation signal.

13. The electromagnetic heating control circuit according to claim 11, wherein the drive circuit is further configured to perform a comparison on the pulse width modulation signal and a preset reference square signal, and to adjust the state of the magnified pulse width modulation signal output by the signal output terminal according to a result of the comparison.

14. The electromagnetic heating control circuit according to claim 11, wherein the switch transistor is an insulated gate bipolar transistor, a collector of the insulated gate bipolar transistor is configured as the first terminal, an emitter of the insulated gate bipolar transistor is configured as the second terminal, and a gate of the insulated gate bipolar transistor is configured as the control terminal.

15. The electromagnetic heating control circuit according to claim 11, wherein when the protection circuit is configured to control the work state of the switch transistor according to the voltage value of the first terminal when the switch transistor is turned off, the protection circuit comprises a voltage sampling circuit and a comparator, wherein:

the voltage sampling circuit comprises a first resistor and a second resistor, one terminal of the first resistor is connected to the first terminal, and the other terminal of the first resistor is connected to the ground terminal via the second resistor; and a non-inverting input terminal of the comparator is connected to a common terminal of the first resistor and the second resistor, an inverting input terminal of the comparator is connected to a preset reference voltage terminal, and an output terminal of the comparator is connected to the control terminal.

16. The electromagnetic heating control circuit according to claim 11, wherein when the protection circuit is configured to control the work state of the switch transistor according to a detected current value of the second terminal when the switch transistor is turned on, the electromagnetic heating control circuit further comprises a current-limiting resistor connected in series between the second terminal and the ground terminal, and a voltage detection terminal of the protection circuit is connected to the second terminal so as to detect the current value of the second terminal.

17. An electromagnetic heating circuit, comprising a coil, a resonance capacitor, a control chip, a drive module, a protection module, and a switch transistor, wherein:

the coil is connected in parallel to the resonance capacitor;

the switch transistor comprises a first terminal, a second terminal, and a control terminal configured to control a connection state between the first terminal and the second terminal, the control terminal is connected to a signal output terminal of the drive module, the first terminal is connected to a terminal of the resonance capacitor, and the second terminal is connected to a ground terminal;

the control chip is configured to output a pulse width modulation signal to the drive module, the pulse width modulation signal is output to the switch transistor via the signal output terminal of the drive module, so as to drive the switch transistor; and the protection module is configured to control a work state of the switch transistor according to a voltage value of the first terminal when the switch transistor is turned off, or the protection module is configured to control the work state of the switch transistor according to a detected current value of the second terminal when the switch transistor is turned on.

18. The electromagnetic heating circuit according to claim 17, wherein when the protection module is configured to control a work state of the switch transistor according to a voltage value of the first terminal when the switch transistor is turned off, the protection module comprises a voltage sampling circuit and a comparator, wherein:

the voltage sampling circuit comprises a first resistor and a second resistor, one terminal of the first resistor is connected to the first terminal, and the other terminal of the first resistor is connected to the ground terminal via the second resistor; and a non-inverting input terminal of the comparator is connected to a common terminal of the first resistor and the second resistor, an inverting input terminal of the comparator is connected to a preset reference voltage terminal, and an output terminal of the comparator is connected to the control terminal.

19. The electromagnetic heating circuit according to claim 17, wherein when the protection module is configured to control a work state of the switch transistor according to a voltage value of the first terminal when the switch transistor is turned off, the protection module comprises a voltage sampling circuit and a comparator, wherein:

the voltage sampling circuit comprises a first resistor and a second resistor, one terminal of the first resistor is connected to the first terminal, and the other terminal of the first resistor is connected to the ground terminal via the second resistor;

a non-inverting input terminal of the comparator is connected to a common terminal of the first resistor and the second resistor, an inverting input terminal of the comparator is connected to a preset reference voltage terminal, and an output terminal of the comparator is connected to the drive module; and when the voltage value of the first terminal is higher than the preset reference voltage, the comparator outputs a control signal to the drive module, the drive module controls the signal output terminal to output a preset level signal according to the control signal, so as to turn on the switch transistor.

20. The electromagnetic heating circuit according to claim 17, wherein when the protection module is configured to control a work state of the switch transistor according to a voltage value of the first terminal when the switch transistor is turned off, the protection module comprises a voltage sampling circuit and a comparator, wherein:

the voltage sampling circuit comprises a first resistor and a second resistor, one terminal of the first resistor is connected to the first terminal, and the other terminal of the first resistor is connected to the ground terminal via the second resistor;

a non-inverting input terminal of the comparator is connected to a common terminal of the first resistor and the second resistor, an inverting input terminal of the comparator is connected to a preset reference voltage terminal, and an output terminal of the comparator is connected to the control chip; and when the voltage value of the first terminal is higher than the preset reference voltage, the comparator outputs a control signal to the control chip, such that the control chip adjusts a duty ratio of the pulse width modulation signal output to the drive module.

21. The electromagnetic heating circuit according to claim 17, wherein when the protection module is configured to control the work state of the switch transistor according to a detected current value of the second terminal when the switch transistor is turned on, the electromagnetic heating circuit further comprises a current-limiting resistor connected in series between the second terminal and the ground terminal, and a voltage detection terminal of the protection module is connected to the second terminal so as to detect the current value of the second terminal.

22. The electromagnetic heating circuit according to claim 17, wherein the electromagnetic heating circuit further comprises a temperature sensor configured to detect a temperature of the switch transistor, the temperature sensor is connected to the protection module, and the protection module is configured to output a control signal to the drive module or to the control chip according to the temperature detected by the temperature sensor, such that the drive module or the control chip adjusts a duty ratio of the pulse width modulation signal output by the signal output terminal or turns off the switch transistor according to the control signal.

23. The electromagnetic heating circuit according to claim 17, wherein the switch transistor is an insulated gate bipolar transistor, a collector of the insulated gate bipolar transistor is configured as the first terminal, an emitter of the insulated gate bipolar transistor is configured as the second terminal, and a gate of the insulated gate bipolar transistor is configured as the control terminal.

* * * * *